US008652744B2

(12) United States Patent
Yohichiroh et al.

(10) Patent No.: US 8,652,744 B2
(45) Date of Patent: Feb. 18, 2014

(54) METHOD FOR MANUFACTURING TONER AND TONER

(75) Inventors: Watanabe Yohichiroh, Fuji (JP); Yoshihiro Norikane, Yokohama (JP); Yasutada Shitara, Numazu (JP); Keiji Makabe, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 170 days.

(21) Appl. No.: 13/112,035

(22) Filed: May 20, 2011

(65) Prior Publication Data

US 2011/0305987 A1 Dec. 15, 2011

(30) Foreign Application Priority Data

Jun. 15, 2010 (JP) ..... 2010-136411

(51) Int. Cl.
*G03G 9/087* (2006.01)

(52) U.S. Cl.
USPC ..... 430/137.1

(58) Field of Classification Search
USPC ..... 430/137.1
See application file for complete search history.

(56) References Cited

U.S. PATENT DOCUMENTS

| | | | | |
|---|---|---|---|---|
| 8,034,526 | B2 | 10/2011 | Watanabe et al. | |
| 2003/0113541 | A1* | 6/2003 | Yamamoto et al. | 428/404 |
| 2008/0248416 | A1 | 10/2008 | Norikane et al. | |
| 2008/0286679 | A1 | 11/2008 | Norikane et al. | |
| 2008/0286680 | A1 | 11/2008 | Norikane et al. | |
| 2008/0292985 | A1 | 11/2008 | Suzuki et al. | |
| 2009/0042118 | A1 | 2/2009 | Suzuki et al. | |
| 2009/0117486 | A1 | 5/2009 | Watanabe et al. | |
| 2009/0239170 | A1 | 9/2009 | Honda et al. | |
| 2009/0317738 | A1 | 12/2009 | Honda et al. | |
| 2009/0325100 | A1 | 12/2009 | Watanabe et al. | |
| 2010/0003613 | A1* | 1/2010 | Honda et al. | 430/110.4 |
| 2010/0021209 | A1 | 1/2010 | Watanabe et al. | |
| 2010/0055590 | A1 | 3/2010 | Honad et al. | |
| 2010/0104970 | A1 | 4/2010 | Norikane et al. | |
| 2010/0227267 | A1 | 9/2010 | Shitara et al. | |
| 2010/0297548 | A1 | 11/2010 | Honda et al. | |
| 2011/0014565 | A1 | 1/2011 | Norikane et al. | |

FOREIGN PATENT DOCUMENTS

| | | |
|---|---|---|
| JP | 05-341577 | 12/1993 |
| JP | 3219316 | 10/2001 |
| JP | 2007-199463 | 8/2007 |
| JP | 2008-065009 | 3/2008 |
| JP | 2009-020418 | 1/2009 |
| JP | 2009-020419 | 1/2009 |
| JP | 2010-102195 | 5/2010 |
| JP | 4562707 | 10/2010 |
| JP | 4647506 | 3/2011 |

* cited by examiner

*Primary Examiner* — Hoa V Le
(74) *Attorney, Agent, or Firm* — Oblon, Spivak, McClelland, Maier & Neustadt, L.L.P.

(57) ABSTRACT

A method for producing toner particles by ejecting a liquid from at least one ejection hole to form the liquid into liquid droplets, and solidifying the liquid droplets to produce toner particles. The ejecting is accomplished by applying a vibration to the liquid in a liquid column resonance-generating liquid chamber in which an ejection hole is formed to form a standing wave through liquid column resonance, and ejecting the liquid from the ejection hole which is formed in a region corresponding to an antinode of the standing wave to thereby form the liquid into the liquid droplets. Toner produced by the method.

8 Claims, 14 Drawing Sheets

METHOD FOR MANUFACTURING TONER AND TONER

CROSS-REFERENCE TO RELATED APPLICATIONS

The present application claims priority to Japanese patent application JP 2010-136411, filed on Jun. 15, 2010, which is hereby incorporated by reference in its entirety.

FIELD OF THE INVENTION

The present invention relates to the manufacturing of toner, to a toner, and its uses.

BACKGROUND OF THE INVENTION

Firstly, a pulverization method, which is a toner production method, is described by way of conventional resin fine particles. The pulverization method is a typical toner production method that has been conventionally employed, and a method in which a toner composition is melt-kneaded by a two-roll or a biaxial extruder, and the melt-kneaded product is cooled, followed by a pulverization treatment of coarse powder, a pulverization treatment of fine powder and a classification treatment, when required, a mixing treatment of external additives such as a fluidizer by a HENSCHEL MIXER, etc. In the pulverization treatment of coarse powder, a ROTOPLEX or pulverizer can be used. In the pulverization treatment of fine powder, a jet mill or turbo mill can be used. In the classification treatment, known production apparatuses such as an ELBOWJET and a variety of air classifiers can be used.

There is a spray method as one of the conventional toner production methods other than the above-mentioned pulverization method. This spray method is a method in which a toner composition is formed into liquid droplets in a vapor phase by using a single-fluid ejection hole (pressurization type ejection hole) sprayer which sprays a liquid from ejection holes by application of pressure, a multiple-fluid spray ejection hole sprayer which sprays a liquid and compressed gases in a mixed form, a rotational disc type sprayer which forms a liquid into liquid droplets by a centrifugal force using a rotating disc, or the like. In the spray method, as a spray-dry system configured to simultaneously perform spraying and drying, a commercially available device can be used, however, when a toner cannot be sufficiently dried, secondary drying such as fluidized bed drying is performed, and when necessary, mixing of external additives such as a fluidizer is performed using a HENSCHEL MIXER etc.

Further, as a conventional toner production method other than the pulverization method, there is a jet granulation method. In the jet granulation method, liquid droplets are ejected from ejection holes each having a diameter as small as the diameter of toner using a vibration generating unit, although a part of forming a liquid into droplets and solidifying the droplets is the same as in the spray method. Conventionally, some jet granulation methods have been proposed. As one of the jet granulation methods, JPO2007-199463 proposed a toner production method, in which the inside of a pressurization chamber is pressurized to generate a liquid column from nozzles, the liquid column is broken into droplets by a weak ultrasonic vibration, and the droplets are dried and solidified to produce a toner, and a toner production apparatus therefor. Such a toner production apparatus generally includes a toner composition liquid-housing container to house a toner composition liquid to be supplied to a pressurization chamber in a liquid droplet jetting unit, and the toner composition liquid-housing container includes a stirring member which stirs the toner composition liquid housed therein to generate a flow. By generating a flow in the toner composition liquid-housing container by the stirring member, respective materials can maintain a uniformly dispersed state in the toner composition liquid, and it is possible to prevent the respective materials from being dispersed with nonuniformity in the toner composition liquid. There is disclosed a toner production apparatus in which a toner composition liquid is pressurized to form a liquid column from through holes, a weak vibration is applied to the liquid column by a vibration generating unit to excite a Rayleigh fission, thereby forming uniform liquid droplets, followed by solidifying the liquid droplets, to thereby produce toner base particles. In the method employing Rayleigh fission, a liquid is pressurized to be ejected, and thus the method has an advantage in that the vibration generating unit is only required to generate a weak vibration, and a toner composition liquid can be formed into droplets with a low voltage.

In a head part disclosed in JP3786034 as a still another example of a toner production method using the jet granulation method, pulse-pressurization is performed to uniformly pressurize the entire system of toner materials stored in a toner material reservoir part for storing the toner materials, and thereby the toner materials are ejected from ejection holes. Hereinbelow, the principles of ejection of liquid droplets disclosed in JP3786034 are outlined with reference to FIGS. 12A to 12E. In FIGS. 12A to 12E, pressure values inside a material reservoir part (a) are described. In the liquid droplet ejecting method disclosed in JP3786034, a toner composition liquid is effected to repeatedly behave three states described below to thereby form liquid droplets intermittently. As a first state, a head part is in a state where no ejection signal is input, that is, as illustrated in FIG. 12A, in a state where no deformation occurs in a piezoelectric body (which may be referred to as piezoelectric element) (b), causing no volume change in a material reservoir part (a), and a material liquid is not ejected from an ejection hole. Next, in a second state, an ejection signal is input, the piezoelectric body (b) undergoes displacement to the inside of the material reservoir part (a), and the material reservoir part (a) decreases as illustrated in FIGS. 12B and 12C. At this time, the pressure inside the material reservoir part (a) is momentarily increased with uniformity, and the material liquid is ejected from the ejection hole. At this time, a flow of the materials is generated from the material reservoir part (a) to the side of a material housing part (not illustrated). Next, as a third state, after completion of the first time ejection of the materials, as illustrated in FIGS. 12D and 32E, application of the voltage is stopped, and the piezoelectric element (b) restores its substantially original shape. At this time, a negative pressure works in the material liquid, and the material liquid in an amount commensurate with an ejection amount is fed from a material housing part called a feeder for housing the material liquid to the material reservoir part (a).

Meanwhile, according to dry process of electric photographic machine, roller and belt and the like for heating is touched dry pattern toner image which is transferred medium like paper medium then toner image on the medium was heated and melted. Then, fixing the toner image onto the medium. Like the above fixing method is well done method because good heat efficiency. According of this fixing method temperature of roller and belt for heating is strong high, so hot offset which is phenomenon for toner is more necessary melted more necessary and fixed to roller and belt is occurred.

For prevent to this occurred of hot offset, so far, release type oil as silicone oil coating, roller anb belt for heating for don't occurred to melt and fix.

However the coating method coating release type oil, in this case, the apparatus needs an oil tank and an oil applicator, and therefore the apparatus must be larger and complicated. There is another problem such that the oil applied to the member tends to adhere to copier papers and overhead projection (OHP) films, Therefore, when water soluble type ink is used to write to copy paper which adhered by oil, there is problem that become bad writable function by cissing water soluble ink, and when projection using OHP, there is the problem that resulting in deterioration of the color tone of the produced images by the adhesive oil to OHP film.

Therefore, as the method which prevent melt and adhered of toner without using oil coating to roller and belt for heat, several methods are proposed that adding release agent to toner itself such as wax.

For example of the above, JPA07-84401 has disclosed toners including a wax having a specific endothermic peak measured by a differential scanning calorimeter (DSC).

JP-A05-341577 has disclosed toners including a release agent such as a candelilla wax, a higher fatty acid wax, a higher alcohol wax, natural plant waxes (a carnauba wax, a rice wax), and a montan ester wax.

However, the toner production method proposed in JPO2007-199463 utilizes Rayleigh fission, and thus when a toner having a small diameter is produced, in order to form liquid droplets having a particle size of about two-times the inner diameter of the ejection hole, the inner diameter of the ejection hole should be made small. Further, this toner production method has a problem that the liquid is pressurized in one direction, and toner components are clogged inside the nozzle depending on the composition of the toner.

In the liquid droplet ejecting method disclosed in JP3786034, a toner composition liquid is effected to repeatedly behave three states described below to thereby form liquid droplets intermittently.

In view of the time spared for the third state and the overall production process time, a time loss occurs, and the liquid ejection method has a problem that the toner production efficiency corresponding to the time loss is reduced.

Further, release agent such as wax of above JPA07-84401, JPA05-341577 are softer than resin and high adhesiveness. Therefore, according to developing process using toner containing a release agent having high adhesiveness, sometimes the added release agent adheres and remains on the organic photoconductor after transfer of the toner image onto the organic photoconductor. Then, there is a filming phenomenon, that adhered release agent contaminates the surface of organic photoconductor.

BRIEF SUMMARY OF THE INVENTION

The present invention solves the above-mentioned problems and achieves the following object. That is, an object of the present invention is to provide a toner and a method of manufacturing such toner which addresses the above problems.

DETAILED DESCRIPTION OF THE PREFERRED EMBODIMENTS

Figure 1:
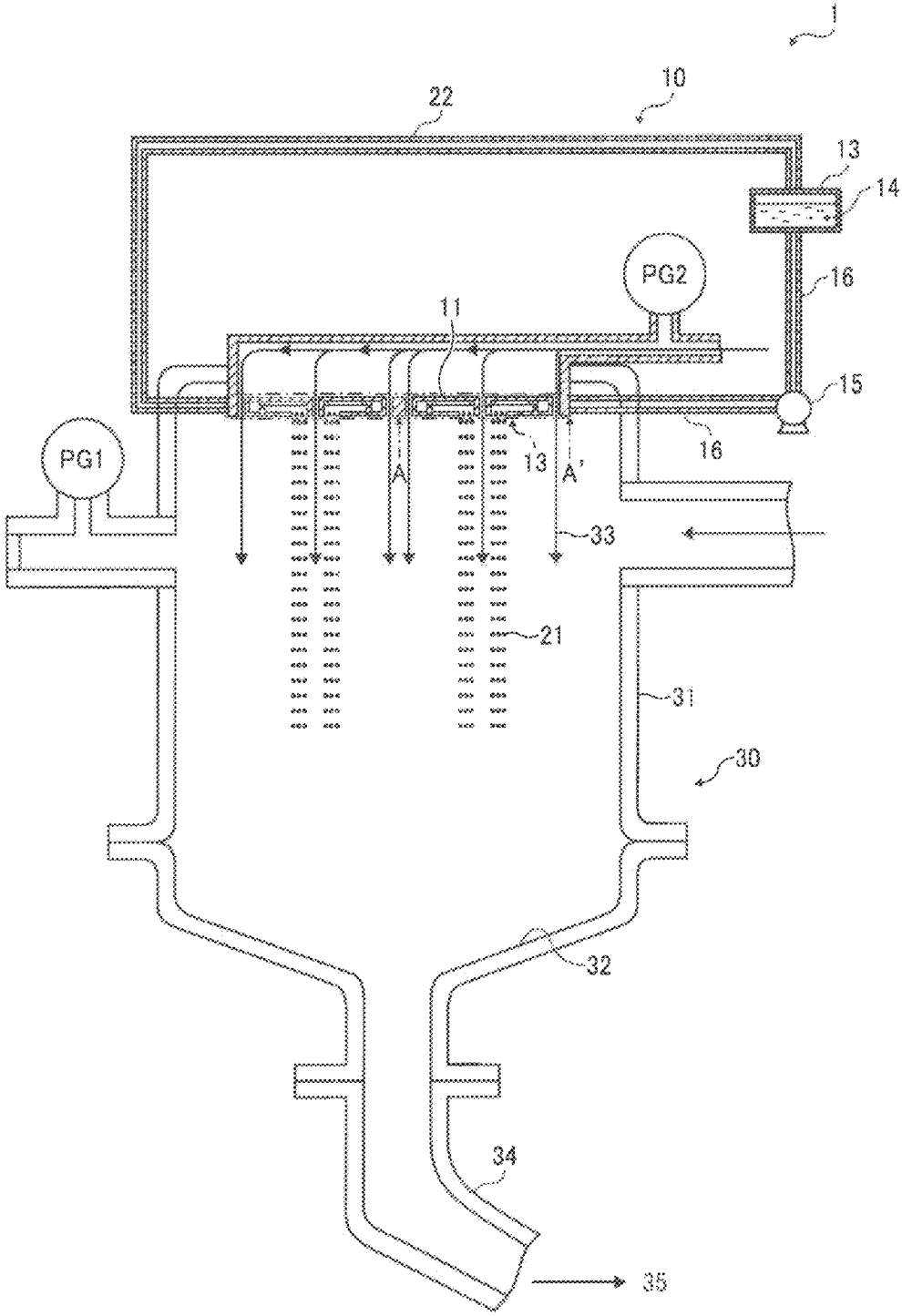
FIG. 1 is a cross-sectional diagram illustrating the overall configuration of a toner production apparatus according to one embodiment of the present invention.

The present invention relates to a method for manufacturing toner, to a toner, and to the uses of the described toner.

In a first embodiment, the present invention provides a production method of fine particles, the production method comprising:

ejecting a liquid from at least one ejection hole to form the liquid into liquid droplets, and solidifying the liquid droplets, wherein the liquid comprises a wax and a graft polymer comprising at least a polyolefin resin unit and a vinyl resin unit in a solvent, and optionally any one or more of a (binder) resin and a colorant, to prepare a toner constituent liquid;

optionally a fine particle-forming component which is dissolved or dispersed in a solvent, or which is fused in the solvent, and wherein the ejecting the liquid droplets is accomplished by applying a vibration to the liquid in a liquid column resonance-generating liquid chamber, in which the ejection hole is formed, to form a standing wave through liquid, and ejecting the liquid from the ejection hole which is formed in a region corresponding to an antinode of the standing wave to thereby form the liquid into the liquid droplets.

Further, a preferred embodiment of the present invention provides a production method of fine particles, wherein the ejection hole is formed in plurality with respect to at least one region, which is the region corresponding to the antinode.

Moreover, a preferred embodiment of the present invention provides the method for manufacturing a toner, wherein the toner constituent liquid comprises the graft polymer in an amount of from 10 to 150 parts by weight based on 100 parts by weight of the wax.

Moreover, a preferred embodiment of the present invention provides the method for manufacturing a toner according to the first embodiment, wherein the vinyl resin comprises at least one member selected from the group consisting of a styrene unit, an alkyl acrylate unit, an alkyl methacrylate unit, an acrylonitrile unit, and a methacrylonitrile unit.

Moreover, a preferred embodiment of the present invention provides a toner, manufactured by the method according to the above method.

Moreover, a preferred embodiment of the present invention provides the toner, manufactured by the above-described method, wherein the toner has a ratio of the weight average particle diameter to a number average particle diameter of from 1.00 to 1.15.

Moreover, a preferred embodiment of the present invention provides a toner, manufactured by the described method, wherein the toner has a weight average particle diameter of from 1 to 20 μm.

In this invention, inside the liquid column resonance-generating chamber which is filled with the toner composition liquid, a pressure distribution is formed by an antinode of a liquid column resonance standing wave generated by the vibration generating unit.

This pressure distribution is not one-sided, then ejection can be efficiently ejected even ejection hole is small.

Further, the ejection hole is formed in the area where there is an antinode of a liquid column resonance standing wave, allowing the toner composition liquid to be discharged via the ejection hole constantly, thus the productivity of toner is high.

Further, the toner composition includes a graft polymer comprising a polyolefin resin unit and a vinyl resin unit, thus binding can be strong between the wax and graft polymer.

That is, the wax does not adhere to the photoconducter in the development process, thus reducing the photoconductor filming phenomenon.

Figure 2:
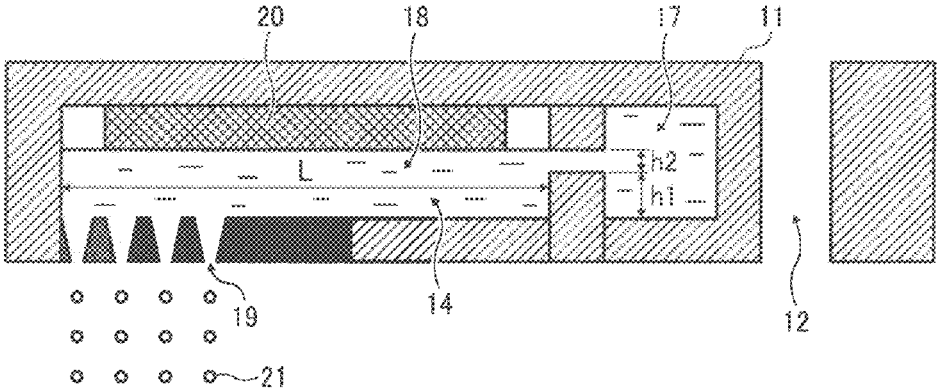
FIG. 2 is a cross-sectional diagram illustrating the configuration of the liquid droplet ejection head in the liquid droplet forming unit (liquid droplet ejection apparatus) in FIG. 1.
Figure 3:
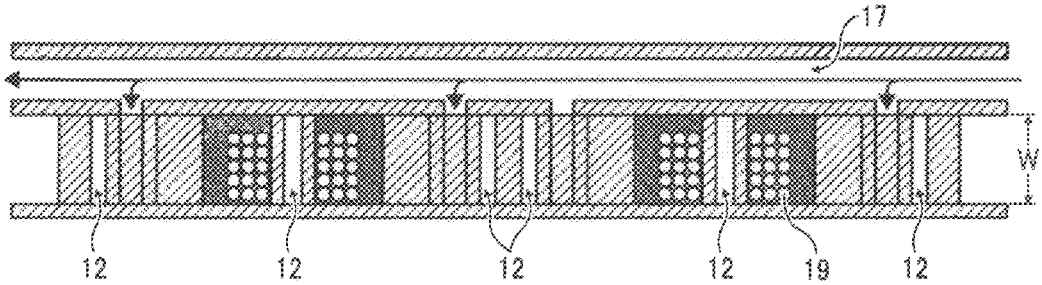
FIG. 3 is an A-A' line cross-sectional diagram illustrating the configuration of the liquid droplet forming unit in FIG. 1.

FIG. 1 is a cross-sectional diagram illustrating the overall configuration of a toner production apparatus according to one embodiment of the present invention. FIG. 2 is a cross-sectional diagram illustrating the configuration of the liquid droplet ejection head in the liquid droplet forming unit (liquid droplet ejection apparatus) in FIG. 1. FIG. 3 is an A-A' line cross-sectional diagram illustrating the configuration of the liquid droplet forming unit in FIG. 1.

A toner production apparatus 1 according to the present embodiment illustrated in FIG. 1 mainly include a liquid droplet forming unit 10 and a dry-collection unit 30. The liquid droplet forming unit 10 includes a plurality of arrays of liquid droplet ejection heads 11 each of which is a liquid droplet forming unit configured to eject a toner composition liquid in a liquid column resonance-generating liquid chamber which is a liquid chamber having a liquid jetting area in communication with exterior portions through ejection holes, and in which a liquid column resonance standing wave is generated under the after-mentioned conditions, as liquid droplets from the ejection holes. On both sides of each of the liquid droplet ejection heads 11, an air stream path 12 is provided, through which an air stream generated by an unillustrated air stream generating unit passes so that liquid droplets of the toner composition liquid ejected from the liquid droplet ejection heads 11 flows out to a dry-collection unit 30. Further, the liquid droplet forming unit 10 includes a material housing container 13 to house a toner composition liquid 14, which is a toner material, and a liquid circulation pump 15 which feeds the toner composition liquid 14 housed in the material housing container 13 to the after-mentioned liquid common feed path 17 in the liquid droplet ejection head 11 via a liquid feed path 16 and further pressure-feeds the toner composition liquid 14 in the liquid feed path 16 so as to be returned to the material housing container 13 via a liquid return pipe 22. Furthermore, the liquid droplet ejection head 11 includes, as illustrated in FIG. 2, a liquid common feed path 17 and a liquid column resonance-generating chamber 18. The liquid column resonance-generating chamber 18 is designed to communicate with the liquid common feed path 17 which is disposed at one wall surface of wall surfaces provided at both ends of the liquid column resonance-generating chamber 18 in a longitudinal direction thereof. In addition, the liquid column resonance-generating chamber 18 includes ejection holes 19 which ejects liquid droplets 21 at one wall surface of wall surfaces connected to the wall surfaces provided at the both ends, and a vibration generating unit 20 which is provided at a wall surface facing the ejection holes 19 and is configured to generate a high frequency vibration for forming a liquid column resonance standing wave. Note that an unillustrated high-frequency power source is connected to the vibration generating unit 20.

The dry-collection unit 30 illustrated in FIG. 1 includes a chamber 31 and a toner collection part 32. In the chamber 31, a large-size downward air stream is formed. In the large-size downward air stream, an air stream generated by an unillustrated air stream-generating unit is united with a downward air stream 33. Since the liquid droplets 21 ejected from the liquid droplet ejection head 11 in the liquid droplet forming unit 10 is conveyed downward by not only gravity but also the downward air stream 33, it is possible to prevent the liquid droplets 21 ejected from decelerating by wind drag (air resistance). With this configuration, when liquid droplets 21 are continuously ejected, it is possible to prevent a liquid droplet 21 ejected in first (former liquid droplet) from decelerating by air resistance and prevent a liquid droplet 21 ejected afterward from catching up with the former liquid droplet 21 to unite with the former liquid droplet 21 to be a liquid droplet 21 having a large particle diameter, i.e., it is possible to prevent the liquid droplets 21 from having large particle diameters. Note that, as an air stream-generating unit, any of the following methods can be employed: a method in which an air blower is provided at an upstream portion to pressurize the inside of the chamber 31, and a method in which the inside of the chamber is sucked from the toner collection part 32 to thereby reduce the pressure. In the toner collection part 32, a rotational air stream generating device (not illustrated) is provided, which generates a rotational air stream rotating around an axis in parallel with a perpendicular direction. Further, the toner collection part 32 includes a toner reservoir part 35 which stores toner particles that have passed through a toner collection tube 34 in communication with the chamber 31 and then dried and solidified.

Next, a toner production process employed by the toner production apparatus according to the present embodiment will be outlined.

The toner composition liquid 14 housed in the material housing container 13 illustrated in FIG. 1 passes through the liquid feed path 16 by the liquid circulation pump 15 for circulating the toner composition liquid 14, flows into the liquid common feed path 17 in a liquid droplet forming unit 10 illustrated in FIG. 3, and then fed to the liquid column resonance-generating chamber 18 in the liquid droplet ejection head 11 illustrated in FIG. 2. Then, inside the liquid column resonance-generating chamber 18 which is filled with the toner composition liquid 14, a pressure distribution is formed by a liquid column resonance standing wave generated by the vibration generating unit 20. The liquid droplets 21 are ejected from the ejection holes 19 arranged in an area corresponding to an antinode of the standing wave through liquid column resonance, the antinode is a portion having a large amplitude in the liquid column resonance standing wave and high pressure variations. The "area corresponding to an antinode of the standing wave through liquid column resonance" means an area other than the node of the standing wave. Preferably, this area is an area having such a sufficiently large amplitude that the liquid is ejected by a change in pressure (pressure variation) of the standing wave, preferably, an area within a range of ±⅔ wavelength and more preferably, an area within a range of ±¼ wavelength from a position where the amplitude of the pressure standing wave becomes a maximum (a node in a speed standing wave) toward a position where the amplitude becomes a minimum. Even when a plurality of ejection holes are formed, it is possible to form substantially uniform liquid droplets from the respective ejection holes, provided that the ejection holes are formed in the area corresponding to an antinode of the standing wave. Further, the liquid droplets can be efficiently ejected, and clogging of ejection holes hardly occurs. Note that the toner composition liquid 14 passed thought the liquid common feed path 17 flows into a liquid return pipe 22 and then returned to the material housing container 13. When the amount of the toner composition liquid 14 in the liquid column resonance-generating chamber 18 is reduced by ejection of the liquid droplets 21, a suction force effected by the liquid column resonance standing wave in the liquid column resonance-generating chamber 18 works, and the flow rate of the toner composition liquid 14 fed from the liquid common feed path 17 is increased, and thereby the liquid column resonance-generating chamber 18 is refilled with the toner composition liquid 14. Upon refilling the liquid column resonance-generating chamber 18 with the toner composition liquid 14, the flow rate of the toner composition liquid 14 passing through the liquid common feed path 17 is restored. In the liquid feed path 16 and liquid return pipe 22, the flow of the toner composition liquid 14 circulating in the apparatus is formed again. Meanwhile, as illustrated in FIG. 1, the liquid droplets 21 ejected from the liquid droplet ejection head 11 in the liquid droplet forming unit 10 are conveyed downward by not only gravity but also the downward air stream 33 which is generated by an unillustrated air stream-generating unit and which passes through an air stream path 12 to be formed. Next, a spiral air stream is formed along a cone-shaped inside surface constituting the toner collection part 32 by a rotational air stream generated by an unillustrated rotational air stream generating device in the toner collection part 32 and the downward air stream 33, and toner particles flow on the spiral air stream and dried and solidified in a laminar state. The dried and solidified toner particles pass through a toner collection tube 34 to be housed in the toner reservoir part 35.

Note that the liquid column resonance-generating liquid chamber 18 in a liquid droplet ejection head 11 is formed to joint a frame formed of a material having such high rigidity that does not adversely influence upon the resonance frequency of the liquid, such as metal, ceramics, and silicon. Further, as illustrated in FIG. 2, a length L between the wall surfaces provided at both ends of the liquid column resonance-generating liquid chamber 18 in a longitudinal direction thereof is determined based on the above-mentioned liquid column resonance principle. Further, a width W of the liquid column resonance-generating liquid chamber 18 illustrated in FIG. 3 is preferably smaller than one-half the length L of the liquid column resonance-generating liquid chamber 18 so as not to give extra frequencies to liquid column resonance. Furthermore, to remarkably increase the productivity, the liquid column resonance-generating chamber 18 is preferably arranged in plurality with respect to one unit of the liquid droplet forming unit 10. The range of the number of the liquid column resonance-generating chamber 18 to be arranged is not particularly limited. However, one liquid droplet forming unit provided with 100 units to 2,000 units of the liquid column resonance-generating chamber 18 is most preferable because both the operability and productivity can be simultaneously achieved. A flow path for liquid feeding is continuously jointed for each liquid column resonance-generating liquid chamber, from the common feed path 17, and a plurality of the liquid column resonance-generating chambers 18 are in communicate with the liquid common feed path 17.

The vibration generating unit 20 in the liquid droplet ejection head 11 is not particularly limited, as long as it can drive at a given frequency. Such an aspect is desired in which a piezoelectric element is laminated to an elastic plate. The elastic plate constitutes part of the wall in the liquid column resonance-generating chamber so that the piezoelectric element comes into contact with the liquid. Examples of material for the elastic plate include piezoelectric ceramics such as lead zirconate titanate (PZT). Generally, since such a material has a small amount of displacement, in most cases, it is used in a laminate form. Besides, piezoelectric polymers such as polyvinylidene fluoride (PVDF), crystal, and single crystal such as LiNbO3, LiTaO3, KNbO3 are exemplified. Furthermore, the vibration generating unit 20 is desirably disposed so that it can be individually controlled for each liquid column resonance chamber. In addition, the following configuration is desired: one material selected from those described above in a block shape is partially cut to fit the arrangement of the liquid column resonance-generating chamber, and respective liquid column resonance-generating chambers can be controlled individually, via an elastic plate.

Further, the aperture diameter of the ejection holes 19 is preferably within a range of 1 μm to 40 μm. When the aperture diameter is smaller than 1 μm, liquid droplets to be formed are very small, and thus it may be impossible to obtain a toner. In addition, when the toner contains solid fine particles of a pigment or the like as a toner component, there is a concern that clogging often occurs in the ejection holes 19, causing a reduction of productivity. When the aperture diameter is greater than 40 μm, the diameter of liquid droplets formed is increased. When the toner particles having a desired particle diameter of from 3 μm to 6 μm by drying and solidifying the liquid droplets, it is sometimes necessary to dilute the toner composition to a very dilute liquid with an organic solvent, and inconveniently, a large amount of dry energy is needed to obtain a certain amount of toner. As can be seen from FIG. 3, it is preferable to provide the ejection holes 19 in the liquid column resonance-generating chamber 18 in its width direction because a number of apertures of the ejections holes can be arranged therein, and thus the productivity is increased.

Further, according to the open position of the ejection holes 19, the liquid column resonance-generating frequency is changed, so it is desirable that determining the liquid column resonance-generating frequency is confirmed by discharging of liquid drops.

The mechanism of formation of liquid droplets in a liquid droplet ejection apparatus, and a fine particle production apparatus of the present invention will be described below.

FIG. 2 is a cross-sectional diagram illustrating a configuration of a liquid droplet ejection head of a liquid droplet ejection apparatus according to one example of the present invention. Specifically, but while not bound by any theory, the following is believed to describe the principle of a liquid column resonance phenomenon generated in a liquid column resonance-generating liquid chamber 18 in a liquid droplet ejection head 11 in FIG. 2. When a sound speed of a liquid in a liquid column resonance-generating liquid chamber 18 is represented by c, and a drive frequency applied to the liquid (medium) from a vibration generating unit 20 is represented by f, a wavelength λ at which resonance of the liquid is generated satisfies the following Equation B.

$$\lambda = c/f \qquad \text{Equation B}$$

In the liquid column resonance-generating liquid chamber 18 in FIG. 2, in the case where both ends are fixed, in which a length from an edge of a frame on a fixed edge side to the other edge thereof on the side of a liquid supply path 16 is represented by L, further, a height h1 (=about 80 [μm]) of an edge of the frame on a liquid supply path 16 is about double the height h2 (=about 40 [μm]) of a communication hole, and the height of this edge is equal to the fixed edge in a closed state, the length L meets an even number times the one fourth (¼) of the wavelength λ, resonance is most efficiently formed. That is, the length L is represented by the following Equation C.

$$L = (N/4)\lambda \qquad \text{Equation C}$$

(where N is an even number)

Also, in the case where both ends are completely open, Equation C is established.

Similarly, in the case where an open end to which a pressure is escaped is provided at one end and the other end is closed (fixed end), i.e., in the case of one-end-fixed or one-end-opened, the resonance is most efficiently formed when the length L meets odd number time times the one-fourth of a wavelength λ. That is, N in Equation C is represented by an odd number.

A drive frequency exhibiting the most efficiency f is derived from Equation B and Equation C.

$$f = N \times c/(4L) \qquad \text{Expression (1)}$$

However, actually, a liquid has a viscosity attenuating a resonance, and thus a vibration does not endlessly amplitude. Even with a frequency close to the high-drive frequency f exhibiting most efficiency as shown in Equation 1, a resonance is generated.

Figure 4A:
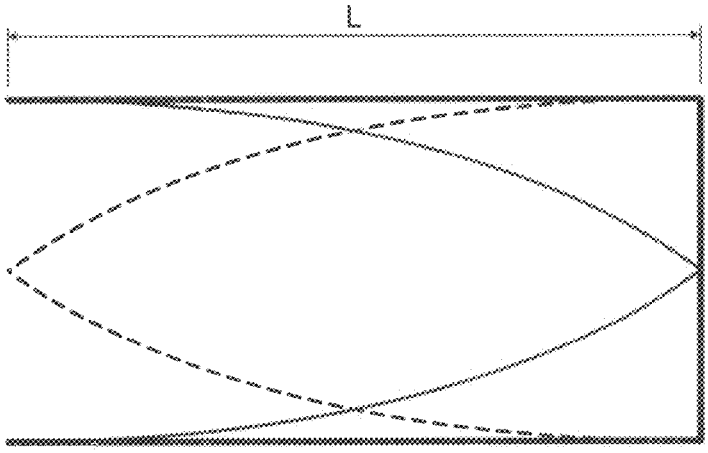
FIG. 4A is a diagram illustrating the shape of a standing wave effected by a speed/pressure variation when N is a natural number of 1.
Figure 4B:
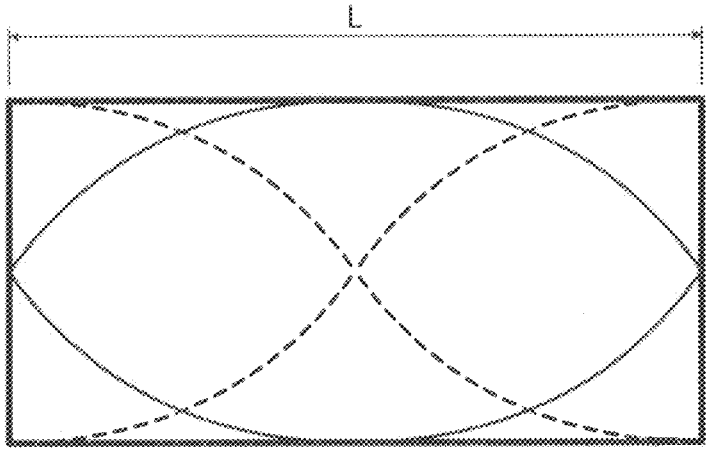
FIG. 4B is a diagram illustrating the shape of a standing wave effected by a speed/pressure variation when N is a natural number of 2.
Figure 4C:
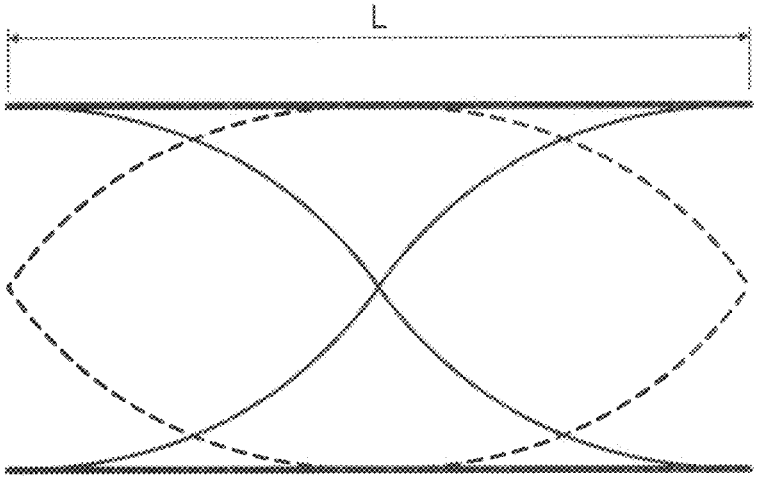
FIG. 4C is a diagram illustrating the shape of another standing wave effected by a speed/pressure variation when N is a natural number of 2.
Figure 4D:
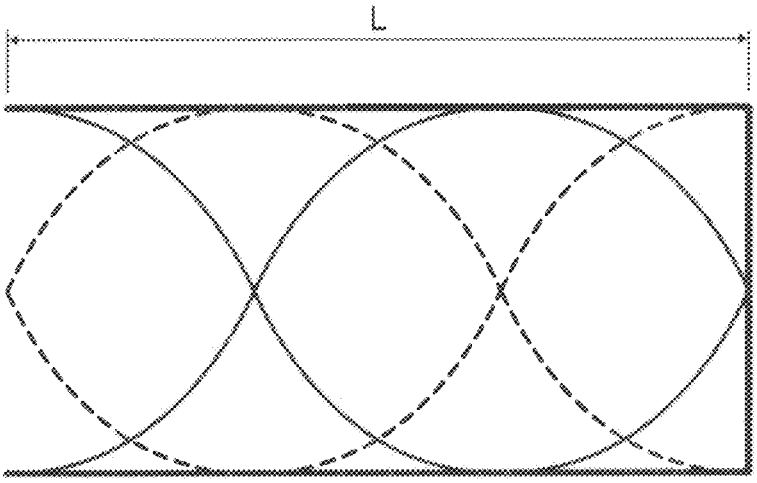
FIG. 4D is a diagram illustrating the shape of a standing wave effected by a speed/pressure variation when N is a natural number of 3.

In FIGS. 4A to 4D, a shape (resonance mode) of a standing wave formed depending on variations of the speed and pressure in the case of N is equal to 1, 2, or 3 (in FIG. 4A, N=1, L=λ/4; in FIG. 4B, N=2, L=λ/2, in FIG. 4C, N=2, L=λ/2, and in FIG. 4D, N=3, L=λ/4). In FIGS. 5A to 5D, a shape (resonance mode) of a standing wave formed depending on variations of the speed and pressure in the case of N is equal to 4 or 5 (in FIG. 5A, N=4, L=λ; in FIG. 5B, N=4, L=λ, and in FIG. 5C, N=5, L=5λ/4). Essentially, the standing wave is a compressional wave (longitudinal wave), however, it is generated represented as illustrated in FIGS. 4A to 4D and 5A to 5C. In these figures, a solid line is a standing wave of the speed, and a dotted line is a standing wave of the pressure applied. For example, as can be seen from FIG. 4A illustrating the case of one-end fixed, with N=1, in the case of a speed distribution, a closed end is provided, and the amplitude of the speed distribution becomes zero. The amplitude becomes a maximum at the open end, which is intuitively understandable with ease. When the length of the liquid column resonance-generating liquid chamber in the longitudinal direction thereof is represented by L, a wavelength at which the liquid causes a liquid-column resonance is represented by λ, a standing wave is most efficiently generated, provided that the integer N is 1 to 5. Further, a standing wave pattern differs depending on a closed-or-open state of the both side, and these different pattern are also described herein. Depending on the aperture of ejection holes and the state of the aperture of ejection holes on the feed path side, the conditions for the ends are determined. Note that in acoustics, an aperture end is an end with which the transfer speed of a medium (liquid) in the longitudinal direction is a maximum, and inversely, the pressure is zero. In contrast, a closed end is defined as an end at which the transfer speed of a medium becomes zero. A closed end is considered as a hard wall from the standpoint of acoustics and in the closed end, reflection of a wave occurs. When it is ideally completely closed or opened, a standing wave through liquid column resonance in the form as illustrated in FIGS. 4A to 4D and 5A to 5C, is generated by super-position of waves, however, the standing wave pattern varies depending on the number of liquid droplet ejection holes, and the aperture position of the liquid droplet ejection holes. A resonance frequency appears at a position shifted from a position determined by Equation 1, and conditions for stable ejection can be created by appropriately adjusting the drive frequency. For example, when a sound speed c of a liquid: 1,200 m/s, a and a length L of a liquid column resonance-generating liquid chamber: 1.85 mm, and wall surfaces are present at both sides, and a resonance mode N=2, which is completely equal to the case where both ends are fixed ends, are used, a resonance frequency having the highest in efficiently is derived as 324 kHz from Equation C. In another example, when a sound speed c of a liquid: 1,200 m/s, a and a length L of a liquid column resonance-generating liquid chamber: 1.85 mm each of which is the same conditions as the above-mentioned example, and wall surfaces are present at both sides, and a resonance mode N=4, which is completely equal to the case where both ends are fixed ends, are used, a resonance frequency having the highest in efficiently is derived as 648 kHz from Expression 1. In a liquid column resonance-generating liquid chamber having the same configuration as described above, a higher-order resonance can also be utilized.

Figure 5A:
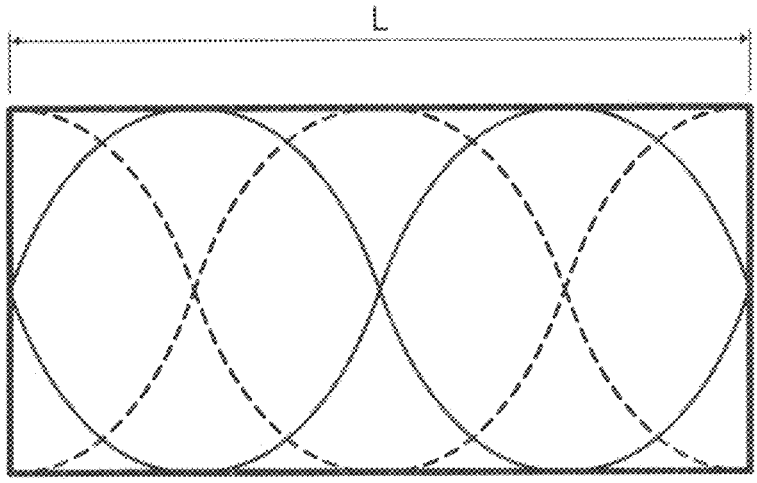
FIG. 5A is a diagram illustrating the shape of a standing wave effected by a speed/pressure variation when N is a natural number of 4.
Figure 5B:
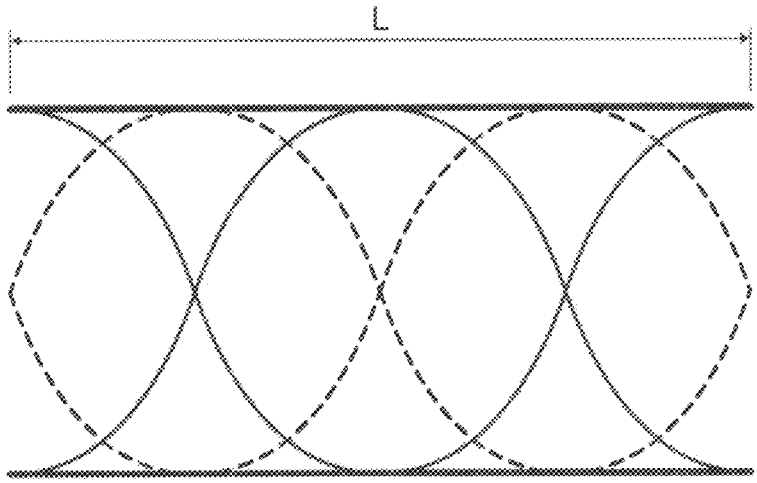
FIG. 5B is a diagram illustrating the shape of another standing wave effected by a speed/pressure variation when N is a natural number of 4.
Figure 5C:
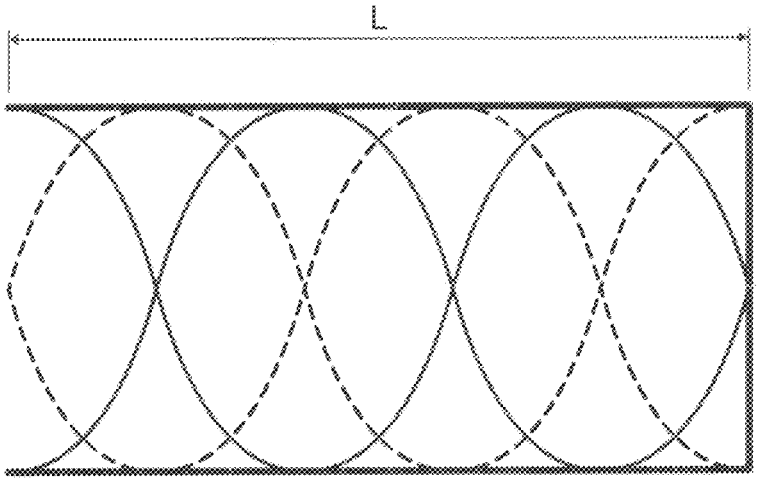
FIG. 5C is a diagram illustrating the shape of a standing wave effected by a speed/pressure variation when N is a natural number of 5.

Note that the liquid column resonance-generating liquid chamber in the liquid droplet ejection head according to the present embodiment illustrated in FIG. 1 and FIG. 2 preferably has ends in a closed state, which are equal to each other, or an end which can be illustrated as a acoustically soft wall in order to increase the frequency, because of the influence of the ejection holes 19 however, the ends may be in an open state. Here, the influence of aperture of ejection holes means that particularly, an acoustic impedance is decreased, and a compliance component is increased. Therefore, a configuration of a liquid column resonance-generating liquid chamber having wall surfaces at both sides thereof in a longitudinal direction thereof as illustrated in FIG. 4B and FIG. 5A, all resonance modes including a resonance mode of both-ends fixed, and one-side open end where the liquid droplet ejection holes size are regarded as open aperture can be utilized, and thus it is a preferred configuration.

Further, a voltage is applied to the vibration generating unit with the determined drive frequency, the vibration generating unit is deformed, and a resonance standing wave is most efficiently generated at the drive frequency. Furthermore, with a frequency close to the drive frequency at which the resonance standing wave is most efficiently generated, a liquid column resonance standing wave is generated. That is, when the vibration generating unit is effected to vibrate using a drive waveform primarily containing a drive frequency fin a range determined by the following Expressions 2 and 3 using both lengths of L and Le, where a length between both ends of the liquid column resonance-generating liquid chamber in a longitudinal direction thereof is represented by L, and a distance between the end of the liquid column resonance-generating liquid chamber on the liquid feed side and a center of a liquid droplet ejection hole nearest to the end of the liquid column resonance-generating liquid chamber on the liquid feed side is represented by Le, to excite liquid column resonance, and thereby liquid droplets can be ejected from ejection holes.

$$N \times c/(4L) \leq f \leq N \times c/(4Le) \quad \text{Expression (2)}$$

$$N \times c/(4L) \leq f \leq (N+1) \times c/(4Le) \quad \text{Expression (3)}$$

Note that a ratio Le/L, i.e., the distance Le between the end of the liquid column resonance-generating liquid chamber on the liquid feed side and a center portion of a liquid droplet ejection hole nearest to the end of the liquid column resonance-generating liquid chamber on the liquid feed side with respect to the length L between both ends of the liquid column resonance-generating liquid chamber in its longitudinal direction is preferably greater than 0.6, i.e., $Le/L>0.6$.

Using the principle of the liquid column resonance phenomenon as described above, a liquid column resonance standing wave is formed in the liquid column resonance-generating chamber 18 illustrated in FIG. 14, and liquid droplets are continuously ejected in the ejection holes 19 arranged at part of the liquid column resonance-generating chamber 18. Note that when the ejection holes 19 are arranged at a position where the pressure of the standing wave varies at most, it is preferable in that the ejection efficiency is increased and driving with low voltage can be achieved. In addition, one ejection hole (the ejection hole 19) may be formed in the liquid column resonance-generating chamber 18, however, from the viewpoint of productivity, it is preferable that a plurality of the ejection holes 19 be formed. Specifically, the number of ejection holes is preferably 2 to 100. When the number of ejection holes exceeds 100, and when desired toner liquid droplets are to be formed from 100 holes of the ejection holes 19, there is a need to set a voltage applied to the vibration generating unit 20 high, and the behavior of the piezoelectric element serving as the vibration generating unit 20 becomes unstable. In addition, in the case where a plurality of the ejection holes are formed, a pitch between the toner ejection holes is preferably 20 μm or greater and equal to or smaller than the length of the liquid column resonance-generating liquid chamber. When the pitch is greater than 20 μm, there is a high probability that liquid droplets discharged from adjacent ejection holes collide with each other to be a large-size droplet, leading to degradation in particle size distribution of the toner.

Next, appearance of liquid column resonance phenomenon generated in a liquid column resonance-generating chamber in a liquid droplet ejection head will be described with reference to FIGS. 6A to 6E. Note that, in FIGS. 6A to 6E, a solid line written in a liquid column resonance-generating liquid chamber represents a speed distribution which is obtained by plotting a speed measured at each measurement position arbitrarily selected from a fixed end side of the liquid column resonance-generating liquid chamber to an end of the liquid column resonance-generating liquid chamber on the liquid feed side, a direction from the liquid feed side toward the liquid column resonance-generating liquid chamber is defined as + (plus), and the opposite direction is defined as – (minus). In addition, in FIGS. 6A to 6E, a dotted line written in the liquid column resonance-generating liquid chamber represents a pressure distribution which is obtained by plotting a pressure value measured at each measurement position arbitrarily selected from the fixed end side of the liquid column resonance-generating liquid chamber to the end of the liquid column resonance-generating liquid chamber on the liquid feed side, a positive pressure with respect to atmospheric pressure is defined as + (plus), and a negative pressure with respect to atmospheric pressure is defined as – (minus). When the pressure is a positive pressure, the pressure is applied in a downward direction in the figures, whereas, when the pressure is a negative pressure, the pressure is applied in an upward direction in the figures. In addition, in FIGS. 6A to 6E, the liquid column resonance-generating liquid chamber is opened on the liquid feed path 16 side, as described above. Since the height of a frame serving as the fixed end of the liquid column resonance-generating liquid chamber is approximately twice or more than the height of an aperture in which the liquid feed path 16 is in communication with the liquid column resonance-generating liquid chamber 18, there are illustrated a speed distribution and a pressure distribution which vary with time under approximate conditions where the liquid column resonance-generating liquid chamber 18 has substantially fixed both ends.

Figure 6A:
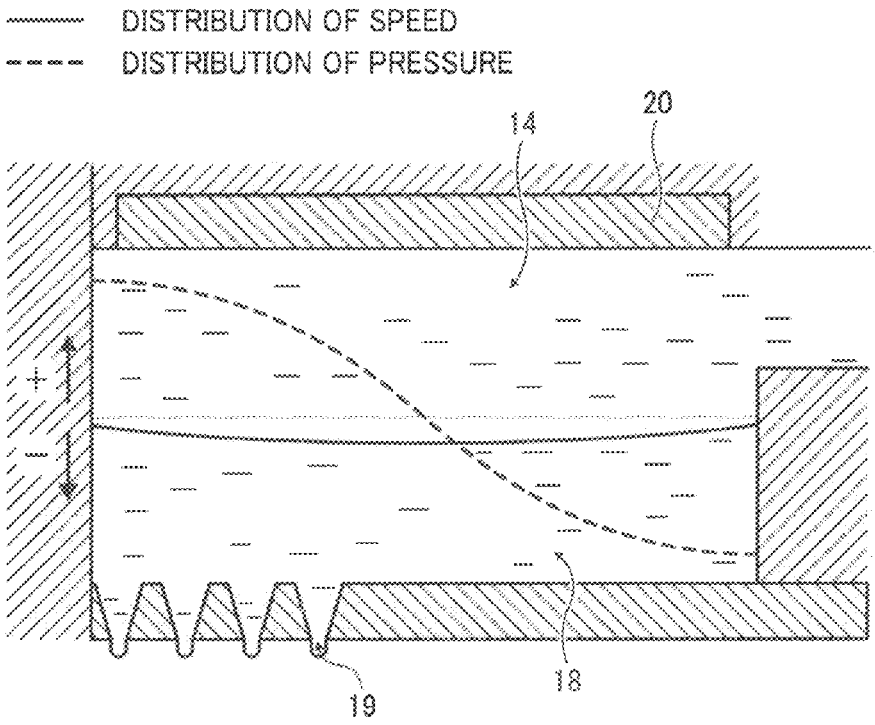
FIG. 6A is a schematic diagram illustrating the appearance of a liquid column resonance phenomenon generated in a liquid column resonance-generating liquid chamber of a liquid ejection head.
Figure 6B:
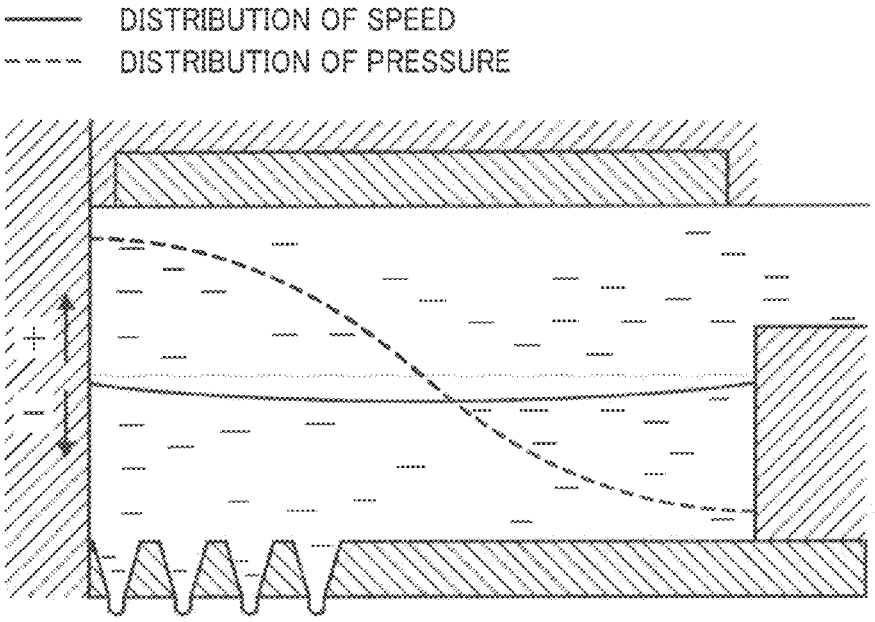
FIG. 6B is another schematic diagram illustrating the appearance of a liquid column resonance phenomenon generated in a liquid column resonance-generating liquid chamber of a liquid ejection head.
Figure 6C:
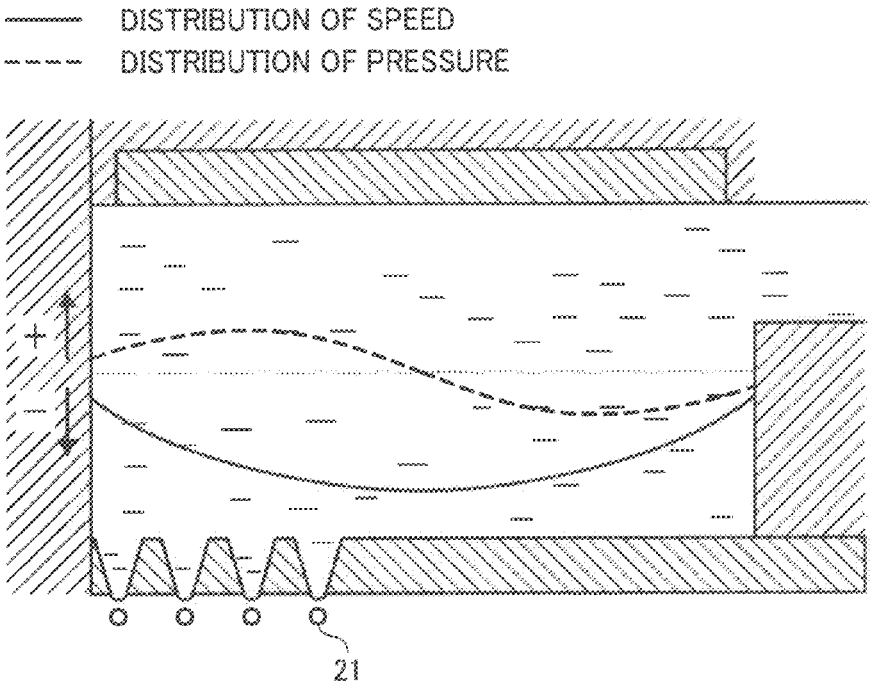
FIG. 6C is still another schematic diagram illustrating the appearance of a liquid column resonance phenomenon generated in a liquid column resonance-generating liquid chamber of a liquid ejection head.

FIG. 6A illustrates a pressure waveform and a speed waveform in the liquid column resonance-generating liquid chamber 18 when liquid droplets are ejected. FIG. 6B illustrates a pressure waveform and a speed waveform in the liquid column resonance-generating liquid chamber 18 when a liquid is fed in the liquid column resonance-generating liquid chamber 18 immediately after the ejection of liquid droplets. As illustrated in FIGS. 7A and 7B, a pressure in the liquid column resonance-generating liquid chamber 18 in which ejection holes 19 are formed is a maximum. The liquid the liquid column resonance-generating liquid chamber 18 flows to the liquid feed path 16 side, and the flow speed (rate) is low. Subsequently, as illustrated in FIG. 7C, a positive pressure in the vicinity of the ejection holes 19 is decreased, and transfers toward a negative pressure direction. The direction to which the liquid flows in the liquid column resonance-generating liquid chamber 18 is the same as illustrated in FIGS. 7A and 7B, i.e., the liquid flows toward the liquid feed path 16 side, however, the flow speed becomes a maximum.

Figure 6D:
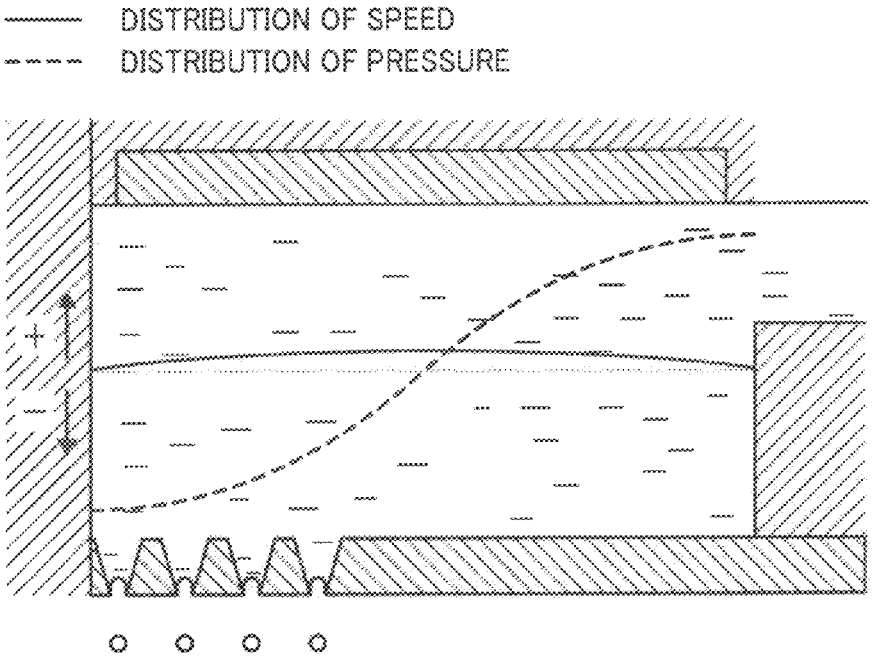
FIG. 6D is yet still another schematic diagram illustrating the appearance of a liquid column resonance phenomenon generated in a liquid column resonance-generating liquid chamber of a liquid ejection head.
Figure 6E:
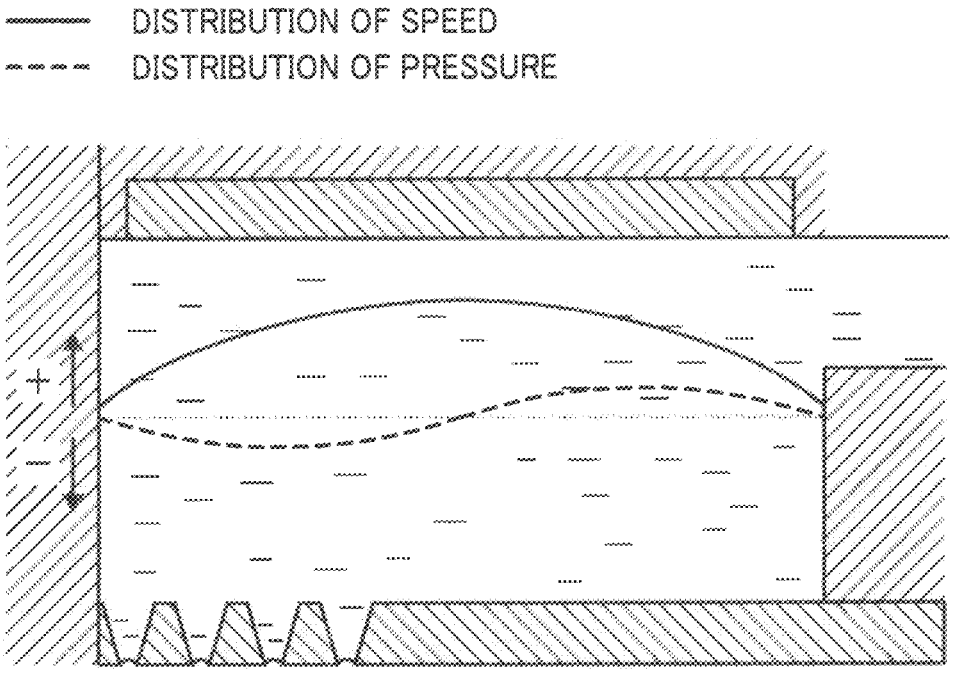
FIG. 6E is further yet still another schematic diagram illustrating the appearance of a liquid column resonance phenomenon generated in a liquid column resonance-generating liquid chamber of a liquid ejection head.

Further, as illustrated in FIG. 6D, the pressure in the vicinity of the ejection holes 19 becomes a minimum. The flow of the liquid in the liquid column resonance-generating liquid chamber 18 changes from the liquid feed path 16 side toward the liquid column resonance-generating liquid chamber 18. The flow speed is low. From this point in time, refilling of the liquid column resonance-generating liquid chamber 18 with the liquid begins. Subsequently, as illustrated in FIG. 7E, the negative pressure in the vicinity of the ejection holes 19 becomes small, and transfers toward a positive direction. The direction to which the liquid flows in the liquid column resonance-generating liquid chamber 18 is the same as illustrated in FIG. 6D, i.e., the liquid flows toward the liquid feed path 16 side, however, the flow speed becomes a maximum. At this point in time, the refilling of the liquid finished. Then, as illustrated in FIG. 6A, the positive pressure in a liquid droplet ejection area in the liquid column resonance-generating liquid chamber 18 becomes a maximum again, liquid droplets 21 are ejected from the ejection holes 19. In this way, in a liquid column resonance-generating liquid chamber, a standing wave through liquid column resonance takes place by a high frequency drive from a vibration generating unit, and because the ejection holes 19 are arranged in a region corresponding to an antinode of the standing wave through liquid column resonance, which is a region where the pressure most greatly varies, the liquid droplets 21 are ejected from the ejection holes 19 according to the cycle of the antinode.

Figure 7:
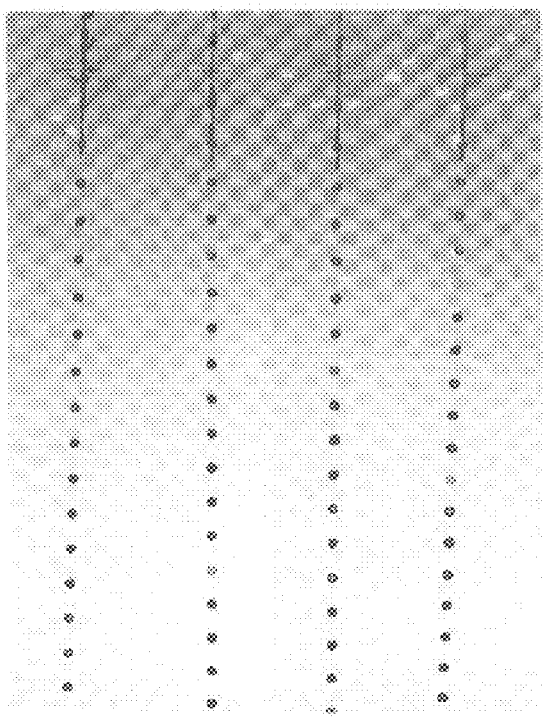
FIG. 7 is a diagram illustrating the appearance of actual liquid droplet ejection.
Figure 8:
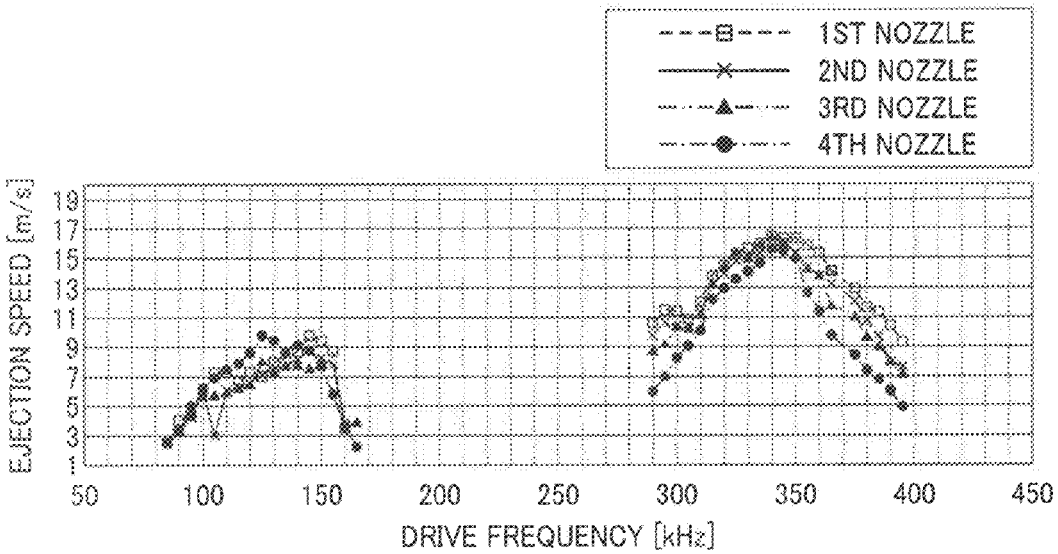
FIG. 8 is a characteristic graph illustrating a relationship between a drive frequency and a liquid droplet ejection speed.

Next, one example of a configuration where liquid droplets are actually ejected by the liquid column resonance phenomenon will be described. This example is a case where in FIG. 2, the length L between both ends of the liquid column resonance-generating chamber 18 in the longitudinal direction thereof is 1.85 mm, and a resonance mode: N=2. Toner ejection holes are arranged at a position corresponding to an antinode of a pressure standing wave based on the resonance mode of N=2, and the appearance of the ejection holes (a first ejection hole to a fourth ejection hole), from which liquid droplets were ejected with a drive frequency of a sine wave at 340 kHz, was photographed by laser shadowgraphy is illustrated in FIG. 7. As can be seen from FIG. 7, ejection of liquid droplets with extremely uniform in diameter and substantially uniform speed was achieved. FIG. 8 is a characteristic graph illustrating characteristics between a drive frequency and a liquid droplet ejection speed, when driving was performed with an amplitude sine wave having the same amplitude as a drive frequency of 290 kHz to 395 kHz. As can be seen from FIG. 8, the ejection speed of liquid droplets from each ejection hole is equalized in the vicinity of drive frequency of 340 kHz, in the first ejection hole to the fourth ejection hole, and a maximum ejection speed is achieved. From this characteristic result, it is understood that uniform ejection is achieved at a position corresponding to an antinode of the liquid column resonance standing wave with a drive frequency of 340 kHz, which is a second mode of liquid column resonance frequency. In addition, from the characteristic result in FIG. 8, it is understood that frequency characteristics of liquid column resonance standing waves that liquid droplets are not ejected during a period between a liquid droplet ejection speed peak at a drive frequency of 130 kHz (first mode) and a liquid droplet ejection speed peak at a drive frequency of 340 kHz (second mode) occurs in the liquid column resonance-generating liquid chamber.

Figure 9:
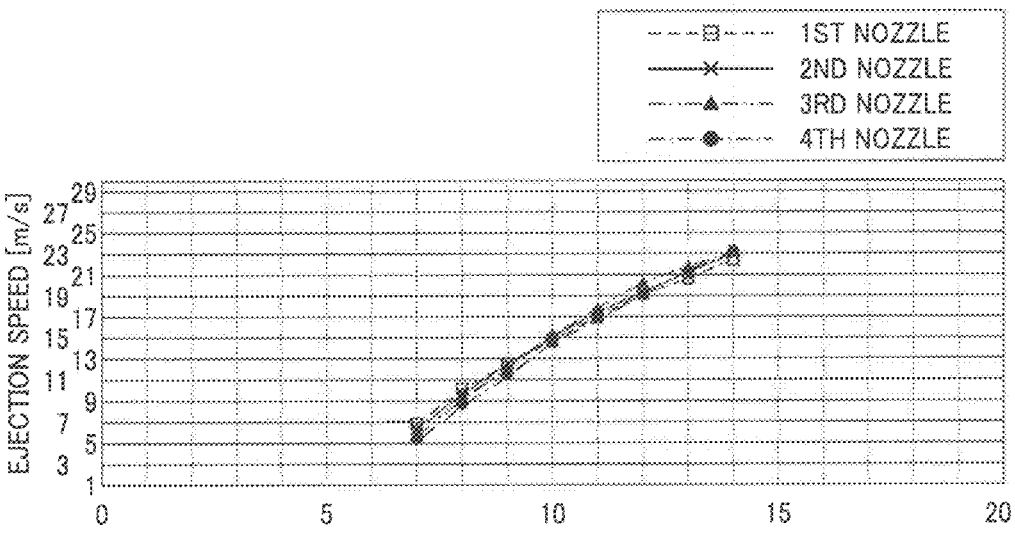
FIG. 9 is a characteristic graph illustrating a relationship between a voltage applied and an ejection speed in each ejection hole.
Figure 10:
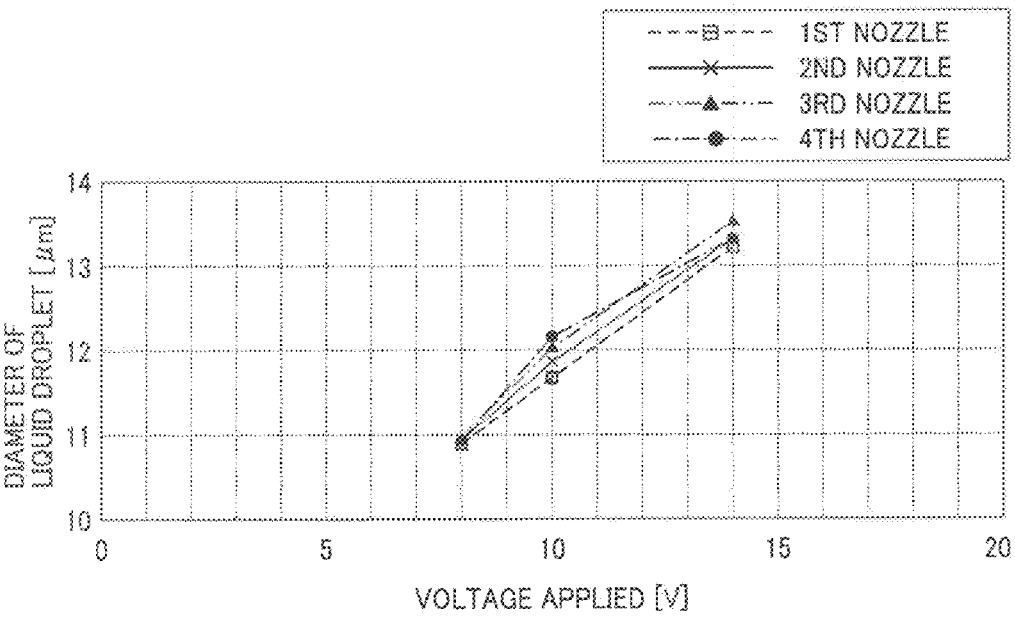
FIG. 10 is a characteristic graph illustrating a relationship between a voltage applied and a diameter of a liquid droplet.

FIG. 9 is a characteristic graph illustrating a relationship between a voltage applied and an ejection speed in each ejection hole. FIG. 10 is a characteristic graph illustrating a relationship between a voltage applied and a diameter of a liquid droplet. As can be seed from these figures, both the ejection speed and diameter of liquid droplets tend to monotonously increase relative to an increase in voltage. Since the ejection speed and the diameter of liquid droplets depend on the voltage applied, the diameter of liquid droplets can be adjusted according to the desired ejection speed or the desired diameter of toner particles can be controlled by adjusting a voltage applied to the piezoelectric element.

Toner

The toner of the present invention includes a wax, a graft polymer including a polyolefin resin unit and a vinyl resin unit, and optionally other constituents. For example, the toner of the present invention can be prepared as follows:

dissolving a binder resin such as a styrene-acrylic resin, a polyester resin, a polyol resin, or an epoxy resin, in an organic solvent;

dispersing a colorant therein;

dispersing or dissolving a wax and a graft polymer including a polyolefin resin unit and a vinyl resin unit therein, to prepare a toner constituent liquid;

forming liquid droplets of the toner constituent liquid by the method mentioned above; and drying the liquid droplets to form solid particles.

The toner constituent liquid can also be prepared by melt-kneading toner constituents, and then dissolving or dispersing the melt-kneaded mixture in an organic solvent.

A toner including a wax and a graft polymer including a polyolefin resin unit and a vinyl resin unit has not only good hot offset resistance but also nozzle clogging resistance because the wax can be finely dispersed in the toner without causing aggregation.

Particle distribution (weight average particle diameter / number average particle diameter) of the toner of this invention is preferably within 1.00 to 1.15. Further, the weight average particle diameter of the toner of this invention is preferably 1 μm to 10 μm.

Resin

The resin herein is different from the graft polymer comprising at least a polyolefin resin unit and a vinyl resin unit. As the resin, a binder resin may be used.

The binder resin is not particularly limited, and may be suitably selected from commonly used resins. Examples of the binder resin include vinyl polymers such as a styrene-based monomer, an acrylic-based monomer and a methacrylic-based monomer, copolymers of at least one of the monomers, polyester-based polymers, polyol resins, phenol resins, silicone resins, polyurethane resins, polyamide resins, furan resins, epoxy resins, xylene resins, terpene resins, coumaroneindene resins, polycarbonate resins, and petroleum-based resins.

Examples of the styrene-based monomer include styrenes such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene or derivatives thereof.

Examples of the acrylic-based monomer include an acrylic acid or acrylic acids such as methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate or esters thereof.

Examples of the methacrylic-based monomer include a methacrylic acid or methacrylic acids such as methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate or esters thereof.

As other monomers forming the vinyl polymer or copolymer, the following monomers (1) to (18) are exemplified. Specific examples thereof are (1) monoolefins (e.g., ethylene, propylene, butylene, and isobutylene); (2) polyenes (e.g., butadiene, and isoprene); (3) halogenated vinyls (e.g., vinyl chloride, vinylidene chloride, vinyl bromide, and vinyl fluoride); (4) vinyl esters (e.g., vinyl acetate, vinyl propionate, and vinyl benzoate); (5) vinyl ethers (e.g., vinyl methyl ether, vinyl ethyl ether, and vinyl isobutyl ether); (6) vinyl ketones (e.g., vinyl methyl ketone, vinyl hexyl ketone, and methyl isopropenyl ketone); (7) N-vinyl compounds (e.g., N-vinyl pyrrole, N-vinyl carbazole, N-vinyl indole, and N-vinyl pyrolidone); (8) vinyl naphthalines; (9) acrylic acid or methacrylic acid derivatives (e.g., acrylonitrile, methacrylonitrile, and acrylamide); (10) unsaturated dibasic acids (e.g., maleic acid, citraconic acid, itaconic acid, alkenylsuccinic acid, fumaric acid, and mesaconic acid);(11) unsaturated dibasic anhydrides (e.g., maleic anhydride, citraconic anhydride, itaconic anhydride, and alkenylsuccinic anhydride); (12) unsaturated dibasic acid monoesters (e.g., maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenylsuccinic acid monomethyl ester, fumaric acid monomethyl ester, and mesaconic acid monomethyl ester); (13) unsaturated dibasic esters (e.g., dimethyl maleate, and dimethyl fumarate); (14) α, β-unsaturated acids (e.g., crotonic acid, and cinnamic acid); (15) α, β-unsaturated anhydrides (e.g., crotonic anhydride, and cinnamic anhydride); (16) anhydrides between the α, β-unsaturated and a lower fatty acid, alkenyl malonic acid, alkenyl glutaric acid, alkenyl adipic acid, acid anhydrides thereof, and monomers having a carboxyl group such as monoesters thereof; (17) acrylic acid or methacrylic acid hydroxy alkyl esters (e.g., 2-hydroxyethyl acrylate, 2-hydroxyethyl methacrylate, and 2-hydroxypropyl methacrylate); and (18) monomers having a hydroxy group (e.g., 4-(1-hydroxy-1-methylbutyl)styrene, and 4-(1-hydroxy-1-methylhexyl)styrene).

In a toner according to the present invention, the vinyl polymer as the binder resin may have a structure crosslinked by a crosslinking agent having two or more vinyl groups. Examples of the crosslinking agent used in this case, as aromatic divinyl compounds, include divinyl benzene, and divinyl naphthalene; as diacrylate compounds each linked by an alkyl chain, include ethylene glycol diacrylate, 1,3-butylene glycol diacrylate, 1,4-butanediol diacrylate, 1,5-pentane diol diacrylate, 1,6-hexanediol diacrylate, neopentyl glycol diacrylate, and compounds where acrylates of these compounds are replaced by methacrylates; and, as diacrylate compounds each linked by an alkyl chain containing an ether bond, include diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds where acrylates of these compounds are replaced by methacrylates.

As the monomer forming the vinyl polymer or copolymer, there may be also exemplified diacrylate compounds and dimethacrylate compounds each linked by a chain containing an aromatic group and an ether bond. As polyester type diacrylates, for example, MANDA (product name, produced by Nippon Kayaku Co., Ltd.) is exemplified.

Examples of polyfunctional crosslinking agents include pentaerythritol acrylate, trimethylolethane triacrylate, trimethylolpropane triacrylate, tetramethylolmethane tetraacrylate, oligoester acrylate, compounds where acrylates of these compounds are replaced by methacrylates, triallyl cyanurate, and triallyl trimellitate.

These crosslinking agents are preferably used in an amount of 0.01 parts by mass to 10 parts by mass, more preferably in an amount of 0.03 parts by mass to 5 parts by mass relative to 100 parts by mass of the other monomer components. Among these crosslinkable monomers, aromatic divinyl compounds (particularly, divinyl benzene), and diacrylate compounds linked by a linking chain containing an aromatic group and one ether bond are preferably exemplified. Among these monomers, preferred is a combination of monomers so as to be a styrene-based polymer or a styrene acrylic-based copolymer.

Examples of a polymerization initiator for use in production of the vinyl polymer or vinyl copolymer of the present invention include 2,2'-Azobisisobutyronitrile, 2,2'-Azobis(4-methoxy-2,4-dimethylvaleronitrile), 2,2'-Azobis(2,4-dimethylvaleronitrile), 2,2'-Azobis(2-methylbutyronitrile), dimethyl-2,2'-azobisisobutylate, 1,1'-azobis(1-cyclohexanecarbonitrile), 2-(carbamoylazo)-isobutyronitrile, 2,2'-Azobis(2,4,4-trimethylpentane), 2-phenylazo-2',4'-dimethyl-4'-methoxyvaleronitrile, 2,2'-Azobis(2-methylpropane), ketone peroxides (e.g., methylethylketone peroxide, acetylacetone peroxide, and cyclohexanone peroxide), 2,2-Bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, di-cumyl peroxide, □-(tert-buthylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropylperoxy dicarbonate, di-2-ethylhexylperoxy dicarbonate, di-n-propylperoxy dicarbonate, di-2-ethoxyethylperoxy carbonate, diethoxyisopropylperoxy dicarbonate, di(3-methyl-3-methoxybutyl)peroxycarbonate, acetylcyclohexylsulfonyl peroxide, tert-butylperoxy acetate, tert-butylperoxyisobutylate, tert-butylperoxy-2-ethylhexalate, tert-butylperoxylaurate, tert-butyl-oxybenzoate, tert-butylperoxyisopropyl carbonate, di-tert-butylperoxy isophthalate, tert-butylperoxyallyl carbonate, isoamylperoxy-2-ethylhexanoate, di-tert-butylperoxyhexahydro phthalate, and tert-butylperoxy azelate.

When the binder resin is a styrene-acrylic-based resin, it is preferable, from the standpoint of fixability, offset resistance and storage stability, for the resin to have a molecular weight distribution by way of GPC, which is soluble in a tetrahydrofuran (THF)(i.e., tetrahydrofuran (THF)-soluble resin fraction), wherein at least one peak is present within a region of a molecular weight of 3,000 to 50,000 (by number average molecular weight conversion), and at least one peak is present within a region of a molecular weight of 100,000 or more. In addition, as the THF-soluble resin fraction), a binder resin containing 50% to 90% of a resin component having a molecular weight of 100,000 or less is preferable; a binder resin having a main peak within a region of a molecular weight of 5,000 to 30,000 is more preferable; and a binder resin having a main peak in a region of a molecular weight of 5,000 to 20,000 is most preferable.

As a monomer constituting the polyester-based polymer, the following are exemplified.

There may be exemplified, as a dihydric alcohol component, ethylene glycol, propylene glycol, 1,3-butane diol, 1,4-butane diol, 2,3-butane diol, diethylene glycol, triethylene glycol, 1,5-pentane diol, 1,6-hexane diol, neopentyl glycol, 2-ethyl-1,3-hexane diol, hydrogenated bisphenol A, or such as a diol that is obtained by compounding a cyclic ether, such as ethylene oxide or propylene oxide with hydrogenated bisphenol A or bisphenol A.

It is preferable to combine the dihydric alcohol with a trihydric or higher polyhydric alcohol in order to cause the polyester resin to form a cross linkage.

Examples of the trihydric or higher polyhydric alcohol include sorbitol, 1,2,3,6-hexane tetrol, 1,4-sorbitan, pentaerythritol, an instance thereof being dipentaerythritol or tripentaerythritol, 1,2,4-butane triol, 1,2,5-pentatriol, glycerol, 2-methylpropane triol, 2-methyl-1,2,4-butane triol, trimethylol ethane, trimethylol propane, or 1,3,5-trihydroxy benzene.

Examples of an acid component forming the polyester-based polymer include a benzene dicarbonate such as phthalic acid, isophthalic acid, or terephthalic acid, as well as the anhydrides thereof, an alkyl dicarbonate such as succinic acid, adipic acid, sebacic acid, or azelaic acid, as well as the anhydrides thereof, an unsaturated dibasic acid, such as maleic acid, citraconic acid, itaconic acid, alkenyl succinic acid, fumaric acid, or mesaconic acid, as well as an unsaturated dibasic anhydride, such as maleic anhydride, citraconic anhydride, itaconic anhydride, or alkenyl succinic anhydride. Examples of trihydric or higher polyhydric carbonic acid component include trimellitic acid, pyromellitic acid, 1,2,4-benzene tricarbonate, 1,2,5-benzene tricarbonate, 2,5,7-naphthalene tricarbonate, 1,2,4-naphthalene tricarbonate, 1,2,4-butane tricarbonate, 1,2,5-hexane tricarbonate, 1,3-dicarboxy-2-methyl-2-methylene carboxy propane, tetra(methylene carboxy)methane, 1,2,7,8-octane tetracarbonate, or Empol trimer, in addition to the anhydrides or partial lower alkyl esters thereof.

When the binder resin is the polyester-based resin, it is preferable, from the standpoint of fixability, offset resistance and storage stability, for the resin to have a molecular weight distribution by way of GPC, which is soluble in a tetrahydrofuran (THF)(i.e., tetrahydrofuran (THF)-soluble resin component), wherein at least one peak is present within a region of a molecular weight of 3,000 to 50,000. In addition, as the THF-soluble resin fraction), a binder resin containing 60% to 100% of a resin component having a molecular weight of 100,000 or less is preferable; a binder resin having at least one peak within a region of a molecular weight of 5,000 to 20,000 is more preferable.

As an acid value when the binder resin is a polyester resin, it is preferable to fall into a range of 0.1 mg KOH/g to 100 mg KOH/g, with a range of 0.1 mg KOH/g to 70 mg KOH/g being more preferable thereupon, and a range of 0.1 mg KOH/g to 50 mg KOH/g being most preferable thereupon.

In the present invention, the molecular weight distribution of the binder resin is measured by gel permeation chromatography (GPC) wherein the THF is the solvent.

As the binder resin usable in the present invention, it is also possible to use, from at least one of the vinyl polymer component and the polyester-based resin component, a resin containing a monomer component capable of reacting with both of the resin component. Examples of the monomer which constitutes the polyester-based resin component and is reactive with a vinyl polymer include an unsaturated dicarboxylic acid, such as phthalic acid, maleic acid citraconic acid, and itaconic acid, as well as the anhydrides thereof. Examples of the monomer which constitutes the vinyl polymer component include those having a carboxyl group or a hydroxy group, as well as an acrylic acid or methacrylamide acid ester.

In addition, when a polyester polymer and a vinyl polymer is combined with another binding resin, it is preferable for the acid value of the binder resin overall to fall into a range of 0.1 mg KOH/g to 50 mg KOH/g, and it is preferable to use these binder resins in an amount of 60% by mass or more.

According to the present invention, the acid value of the binder resin component of the toner composition material is derived by a method that is described hereinafter. The basic operation thereof is performed in accordance with JIS K-0070.

(1) Either prepare the material to be examined by either removing an additive other than the binder resin, i.e., the polymer component, or obtain the acid value and a weight by component of the component other than the binder resin and the cross linked binder resin prior to commencement. An amount of a powdered form of the material to be examined of between 0.5 g and 2.0 g is precisely weighed, and a weight of the polymer component of the material thus weighed is treated as "Wg". As an instance thereof, when measuring the acid value of the binder resin from the toner, the acid value and the weight by component of such as the coloring agent or the magnetic substance is measured separately from one another, and the acid value of the binder resin derived by taking the total of the acid values of the components of the binder resin.

(2) The material to be tested is placed in a 300 mL beaker, and dissolved by an addition into the beaker of 150 mL of a 4:1 (volume ratio) mixture of toluene/ethanol.

(3) A KOH ethanol solvent at 0.1 mol/L is titrated using a potentiometric titration device.

(4) The following Equation is used to calculate the acid value of the binder resin, wherein a weight of the KOH solvent that is used in the present circumstance is treated as S (mL), the weight of the KOH solvent that is used in when another empty measurement is made simultaneously is treated as B (mL), and f is a KOH factor thereupon:

$$\text{Acid value [mgKOH/g]}=[(S-B)\times f\times 5.61]/W$$

The binder resin for toner and the composition containing the binder resin preferably has a glass transition temperature (Tg) of 35° C. to 80° C., and more preferably has a Tg of 40° C. to 75° C., from the standpoint of storage stability of the resulting toner. When the Tg is lower than 35° C., the toner is liable to degrade in a high-temperature atmosphere, and the toner may be liable to cause offset when being fixed. When the Tg is higher than 80° C., the fixability may degrade.

[Colorant]

The colorant is not particularly limited and may be suitably selected from among commonly used resins for use. Examples of the colorant include carbon black, nigrosine dye, iron black, naphthol yellow S, Hansa yellow (10G, 5G, G), cadmium yellow, yellow iron oxide, ocher, yellow lead, titanium yellow, Polyazo yellow, oil yellow, Hansa yellow (GR, A, RN, R), pigment yellow L, benzidine yellow (G, GR), permanent yellow (NCG), Vulcan fast yellow (5G, R), Tartrazine Lake quinoline yellow Lake, Anthrazane yellow BGL, isoindolinone yellow, burnt ocher, cinnabar, lead vermillion, cadmium red, cadmium mercury red, antimony vermillion, permanent red 4R, para red, parachlororthonitro aniline red, Lithol fast scarlet G, brilliant fast scarlet, brilliant carmine BS, permanent red (F2R, F4R, FRL, FRLL, F4RH), fast scarlet VD, Vulcan fast rubine B, brilliant scarlet G, Lithol rubine GX, permanent red F5R, brilliant carmine 6B, pigment scarlet 3B, Bordeaux 5B, toluidine maroon, permanent Bordeaux F2K, Helio Bordeaux BL, Bordeaux 10B, Bon maroon light, Bon maroon medium, eosin Lake, rhodamine Lake B, rhodamine Lake Y, alizarin Lake, thioindigo red B, thioindigo maroon, oil red, Quinacridone red, pyrazolone red, Polyazo red, chromium vermillion, benzidine orange, perinone orange, oil orange, cobalt blue, cerulean blue, alkali blue Lake, peacock blue Lake, Victoria blue Lake, non-metallic phthalocyanine blue, phthalocyanine blue, fast sky blue, indanthrene blue (RS, BC), indigo, lapis lazuli, ultramarine, anthraquinone blue, fast violet B, methyl violet Lake, cobalt purple, manganese purple, dioxane violet, anthraquinone violet, chromium green, zinc green, chromium oxide, viridian, emerald green, pigment green B, naphthol green B, green gold, acid green Lake, malachite green Lake, phthalocyanine green, anthraquinone green, titanium oxide, zinc pink, or Litho Bon, and mixtures thereof.

The amount of the colorant contained in the toner is preferably 1% by mass to 15% by mass, and more preferably 3% by mass to 10% by mass.

A colorant for use in a toner according to the present invention may also be used as a masterbatch which is compounded with the resin. As an instance of the binder resin that is used in the production of the masterbatch, or that is mixed and kneaded with the masterbatch, in addition to both the modified and unmodified polyester resins described above, there may be exemplified styrene, such as polystyrene, poly p-chlorostyrene, or polyvinyl toluene, as well as a polymer of a substitution product of these styrenes; a styrene-based copolymer such as styrene-p-chlorostyrene copolymer, styrene-propylene copolymer, styrene-vinyl toluene copolymer, styrene-vinyl naphthalene copolymer, styrene methylacrylate copolymer, styrene-ethylacrylate copolymer, styrene-butylacrylate copolymer, styrene-octylacrylate copolymer, styrene-methylmethacrylate copolymer, styrene-ethylmethacrylate copolymer, styrene-butylmethacrylate copolymer, styrene-α-methylchlormethacrylate copolymer, styrene-acrylonitrile copolymer, styrene-vinyl methylketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylate resin, rosin, modified rosin, terpene resin, aliphatic or alicyclic hydrocarbon resin, aromatic petroleum resin, paraffin chloride, and paraffin wax. These may be used alone or in combination.

It is possible to obtain the master batch by imparting a strong shearing force to the resin and the colorant for the master batch, thereby compounding and mixing the resin and the colorant. In such a circumstance, it is possible to employ an organic solvent in order to increase an interaction between the colorant and the resin. In addition, a so-called flashing method, wherein a water-based paste, which includes the colorant in water, is compounded and mixed with the resin and the organic solvent, the colorant is caused to transition to the resin side of the mixture, and the water component and the organic solvent component are removed, is ideal, owing to the fact that a wet cake of the colorant may be employed as is, without needing to be desiccated. A strong shearing dispersal apparatus, such as a triple roll mill, would be ideal for the compounding and mixing of the colorant, the resin, and the organic solvent.

The use amount of the masterbatch is preferably 0.1 parts by mass to 20 parts by mass relative to 100 parts by mass of the binder resin.

In addition, it is preferable for the resin of the master batch to have an acid value of 30 mg KOH/g or lower, an amine value that falls into a range of 1 to 100, and to be used with the colorant dispersed thereupon, with an acid value of 20 mg KOH/g or lower, an amine value that falls into a range of 10 to 50, and to be used with the colorant dispersed thereupon being more preferable. When the acid value is higher than 30 mg KOH/g, the chargeability of the masterbatch degrades under a high moisture condition, and thus, the pigment dispersibility to the masterbatch may be insufficient. In addition, the pigment dispersibility to the masterbatch may also be insufficient when the amine value is less than 1 or the amine value is greater than 100. Note that it is possible to measure the acid value by a method that is specified in JIS K-0070, and that it is possible to measure the amine value by a method described in JIS K-7237.

In addition, from the standpoint of the pigment dispersibility, the dispersant preferably has a strong compatibility with the binder resin, and as a concrete commercially available dispersant having the strong compatibility with the binder resin, there may be exemplified AJISPER PB821 and AJISPER PB822, produced by Ajinomoto Fine-Techno Co., Inc., DISPERBYK-2001, produced by Byk Additives & Instruments, and EFKA-4010, produced by EFKA Additives (a member of Ciba Specialty Chemicals).

The weight average molecular weight of the dispersant preferably falls into a range of 500 to 100,000, a main peak, i.e., a local maximum, of the molecular weight, with respect to a styrene conversion mass as determined by the gel permeation chromatography, and it is more preferable, from the standpoint of the pigment dispersibility, the weight-average molecular weight of the dispersant to fall into a range of 3,000 and 100,000, with a range of 5,000 to 50,000 being particularly preferable, and a range of 5,000 to 30,000 being most preferable. When the molecular weight is less than 500, the polarity may increase, and the colorant dispersibility may degrade, whereas, when the molecular weight is greater than 100,000, the affinity of the dispersant with the solvent may increase, and the colorant dispersibility may degrade.

The addition amount of the dispersant is preferably 1 part by mass to 200 parts by mass, and more preferably 5 parts by mass to 80 parts by mass, relative to 100 parts by mass of the colorant. When the addition amount of the dispersant is less than 1 part by mass, the dispersibility may decrease, whereas, when it is more than 200 parts by mass, the chargeability made degrade.

<Wax>

The toner composition liquid for use in the present invention may contain a wax together with a binder resin and a colorant.

The wax is not particularly limited and may be suitably selected from among commonly used ones for use. Examples of the wax include an aliphatic hydrocarbon wax, such as low molecular weight polyethylene, low molecular weight polypropylene, a polyolefin wax, microcrystalline wax, paraffin wax, or Sasol wax, an oxide of an aliphatic hydrocarbon wax, such as polyethylene oxide wax, or a block copolymer of these waxes, a plant derived wax such as candelilla wax, carnauba wax, vegetable wax, or jojoba wax, an animal product wax such as beeswax, lanolin, or spermaceti, a mineral based wax such as Ozokerite, ceresin, or petrolatum, or a type of wax that treats a fatty acid ester as a primary component, such as montanoic acid ester wax or castor wax. In addition, a partially or totally deoxidized fatty acid ester wax, such as deoxidized carnauba wax may also be exemplified.

Furthermore, as the wax that is used together with the binder resin and the colorant, there may also be exemplified a saturated linear chain fatty acid, such as palmitic acid, stearic acid, montanic acid, or a linear chain alkyl carbonate further containing a linear chain alkyl, an unsaturated fatty acid such as eleostearic acid or parinaric acid, a saturated alcohol such as stearyl alcohol, eicosyl alcohol, behenyl alcohol, carnaubyl alcohol, ceryl alcohol, melissyl alcohol, or a long chain alkyl alcohol, a polyvalent alcohol such as sorbitol, a fatty acid amide such as linoleate amide, olefiate acid amide, or laurate amide, a saturated fatty acid bisamide such as methylene biscapriate amide, ethylene-bis laurate amide, hexamethylene-bistearate, an unsaturated fatty acid amide such as ethylene bisoleate amide, hexamethylene bisoleate amide, N,N'-dioleal adipate amide, or N,N'-dioleal sebacate amide, an aromatic bisamide such as m-xylene bistearate amide, N,N-distearyl isophthalate amide, a fatty acid metallic salt such as calcium stearate, calcium laurate, zinc stearate, or magnesium stearate, a wax that is grafted by employing a vinyl monomer, such as styrene or acrylate upon a aliphatic hydrocarbon wax, a compound of a fatty acid and a partial ester polyvalent alcohol, such as behenic acid monoglyceride, or a methyl ester compound, containing a hydroxyl group, that is obtained by adding a hydrogen to a vegetable derived oil or fat.

More preferred examples of the wax include a polyolefin that is formed by radical polymerization of an olefin under a high pressure, a polyolefin that is obtained when polymerizing a high molecular weight polyolefin by refining a low molecular weight by-product of the polymerizing of the high molecular weight polyolefin, a polyolefin that is polymerized by employing a medium at low pressure, such as a Ziegler medium or a metallocene medium, a polyolefin that is polymerized by employing a radiation, an electromagnetic wave, or a light, a low molecular weight polyolefin that is obtained by thermally cracking a high molecular weight polyolefin, paraffin wax, microcrystalline wax, Fischer-Tropsch wax, a synthetic hydrocarbon wax that is synthesized by such as Zintol method, Hydrocol method, or AG method, a synthetic wax that treats a single carbon compound as a monomer, a hydrocarbon wax containing a functional group such as a hydroxide group or a carboxyl group, a compound of a hydrocarbon wax with a hydrocarbon wax containing a functional group, or a modified wax, treating the waxes described herein as a matrix, whereupon a vinyl monomer, such as styrene, maleic acid ester, acrylate, methacrylate, or maleic acid anhydride is grafted.

In addition, it is preferable for the waxes described herein to be employed subsequent to employing a press sweat technique, a solvent technique, a recrystallization technique, a vacuum distillation technique, a supercritical gas extraction technique, or a solution crystallization technique to sharpen the molecular weight distribution, as well as to remove a low molecular weight solid fatty acid, a low molecular weight solid alcohol, a low molecular weight solid compound, or another such impurity thereupon.

The melting point of the wax is preferably, in order to achieve a balance between fixability and offset resistance, 70° C. to 140° C., and more preferably 70° C. to 120° C. When the melting point is lower than 70° C., the blocking resistance may degrade, whereas, when it is higher than 140° C., the offset resistance effect may be hardly exhibited.

In addition, combining two or more different types of wax will allow simultaneously exhibiting a plasticizing effect and a release effect, which are effects of the wax. As an example of the type of wax having the plasticizing effect, there may be exemplified a wax having a low melting point, or a structure further having a branched or a polar group with respect to a molecular structure of the wax. As an example of the type of wax having the plasticizing effect, there may be exemplified a wax having a low melting point, or a structure further having a branched or a polar group with respect to a molecular structure of the wax. As an example of the type of wax having the release effect, there may be exemplified a wax having a high melting point, or, as a molecular structure of the wax, a wax having a linear chain structure or a non-polar type wax which does not include a functional group. As a use example of a combination wax, there may be exemplified a combination wherein a difference between the melting points of two or more different kinds of wax falls into a range of 10° C. to 100° C., or a combination of polyolefin and a modified polyolefin that is grafted upon the polyolefin.

When selecting the two types of wax, in a circumstance wherein the two types of wax contain a similar structure, the wax having a relatively lower melting point exhibits the plasticizing effect, whereas the wax having a relatively higher melting point exhibits the release effect. In such a circumstance, a division of the functions between the two types of wax is exhibited in an effectual manner when the difference between the melting points falls within a range of 10° C. to 100° C. When the difference between the melting points is lower than 10° C., the effect of the division of the functions may not be exhibited, whereas when the difference between the melting points is higher than 100° C., a performance of an emphasis of the functions of the two types of wax by way of an interaction may be impeded. In such a circumstance, given that a trend toward an case in the effecting the division of the functions is present, at least one of the waxes preferably has a melting point of 70° C. to 120° C., with a range of 70° C. to 100° C. being more preferable.

Within the wax thus formed, a modified wax component having a branching structure or a functional group such as a polar group, thereby differing relatively from the primary component of the compound wax exhibits the plasticizing effect, whereas the invariant, i.e., linear, wax component that has a linear chain structure or that is nonpolar, having no functional group, exhibits the release effect. As a preferable wax combination, there may be exemplified a combination of a polyethylene homopolymer or copolymer that treats ethylene as the primary component of the homopolymer or copolymer with a polyolefin homopolymer or copolymer that treats an olefin other than ethylene as the primary component of the homopolymer or copolymer, a combination of a polyolefin and a grafted metamorphic polyolefin, a combination of an alcohol wax, a fatty acid wax, or an ester wax with a hydrocarbon wax, a combination of a Fischer-Tropsch wax or a polyolefin wax with a paraffin wax or a microcrystalline wax, a combination of a Fischer-Tropsch wax with a polyolefin wax, a combination of a paraffin wax with a microcrystalline wax, or a combination of carnauba wax, candelilla wax, rice wax, or montanic wax with a hydrocarbon wax.

Regardless of the combination that is chosen, it is easy to achieve a balance between the storage stability and the fixability of the toner, and thus, with respect to an endothermic peak that is observed with a DSC measurement of the toner, it is preferable for a maximum peak temperature to be present within a region of 70° C. to 110° C., with a region of 70° C. to 110° C. having the maximum peak temperature being more preferable.

The total amount of the waxes is preferably 0.2 parts by mass to 20 parts by mass and more preferably 0.5 part by mass to 10 parts by mass relative to 100 parts by mass of the binder resin.

According to the present invention, the maximum peak temperature of the endothermic peak of the wax, which is measured with the DSC, is presumed to be the melting point of the wax.

As a DSC measurement instrument of the wax or the toner, it is preferable to perform the measurement with a differential calorimetry in an intra-cooler power compensation type with high precision. A method of the measurement is performed in accordance with ASTM D3418-82. A DSC curve that is employed according to the present invention is employed, after the temperature of the substance to be measured is caused to increase and decrease through a single cycle, and a history taken thereupon, when the temperature of the substance is measured upon being caused to increase at a speed of 10° C./min.

(Graft Polymer)

The graft polymer for use in the present invention has a structure such that a vinyl resin is grafted to a polyolefin resin. As the vinyl resin, any known homopolymers and copolymers of a vinyl monomer can be used.

In the toner of the present invention, the wax is at least partially incorporated into or adhered to the graft polymer.

The graft polymer prevents fine particles of the wax from migrating and re-aggregating in the toner constituent liquid. This is because the polyolefin resin portion of the graft polymer has a high affinity for the wax, while the vinyl resin portion has a high affinity for the binder resin, resulting in generating dispersing effect of the wax.

In terms of preventing the occurrence of hole clogging, the dispersion diameter of the graft polymer and the wax is preferably not greater than half of the opening diameter of the hole.

Specific examples of the olefins composing the polyolefin resin include, but are not limited to, ethylene, propylene, 1-butene, isobutylene, 1-hexene, 1-dodecene, and 1-octadecene.

As the polyolefin resin, polymers of an olefin (hereinafter referred to as olefin polymer), oxides of olefin polymer, modified olefin polymer, and copolymers of an olefin with other monomer capable of copolymerizing with the olefin can be used.

Specific examples of the olefin polymers include, but are not limited to, polyethylene, polypropylene, ethylene/propylene copolymer, ethylene/1-butene copolymer, and propylene/1-hexene copolymer.

Specific examples of the oxides of olefin polymers include, but are not limited to, oxides of polymers of the above-mentioned olefins.

Specific examples of the modified olefin polymers include, but are not limited to, maleic acid derivative adducts of polymers of the above-mentioned olefins. Specific examples of the maleic acid derivative adducts include, but are not limited to, maleic anhydride, monomethyl maleate, monobutyl maleate, and dimethyl maleate.

Thermally degraded olefin polymer can also be preferably used. The thermally degraded olefin polymer is a polyolefin resin obtained by thermally degraded a polyolefin resin (such as polyethylene and polypropylene) having a weight average molecular weight of from 50,000 to 5,000,000 at a temperature of from 250 to 450° C. The resultant thermally degraded polyolefin resin preferably includes double bonds in an amount of from 30 to 70% per one molecule, which is calculated from the number average molecular weight thereof.

Specific examples of the copolymers of an olefin with other monomer capable of copolymerizing with the olefin include, but are not limited to, copolymers of an unsaturated carboxylic acid or an alkyl ester thereof with an olefin. Specific examples of the unsaturated carboxylic acids include, but are not limited to, (meth)acrylic acid, itaconic acid, and maleic anhydride Specific examples of the alkyl esters of the unsaturated carboxylic acid include, but are not limited to, alkyl ester of a (meth)acrylic acid having 1 to 18 carbon atoms, and alkyl esters of maleic acid having 1 to 18 carbon atoms.

In the present invention, the polyolefin resin does not need to be formed from an olefin monomer, so long as the resultant polymer (i.e., the polyolefin resin) has a polyolefin structure. Therefore, a polymethylene such as SASOL wax, for example, can be used as a monomer for preparing the polyolefin resin.

Among the above polyolefin resins, olefin polymers, thermally degraded olefin polymers, oxides of olefin polymers, and modified olefin polymers are preferably used; polyethylene, polymethylene, polypropylene, and ethylene/propylene copolymer and thermally degraded compounds thereof, oxidized polyethylene, oxidized polypropylene, and maleinated polypropylene are more preferably used; and thermally degraded polyethylene and polypropylene are much more preferably used.

The polyolefin resin typically has a softening point of from 60 to 170° C., and preferably from 70 to 150° C. When the softening point is greater than 70° C., fluidity of the resultant toner increases. When the softening point is less than 150° C., the resultant toner has good separating ability.

The polyolefin resin typically has a number average molecular weight of from 500 to 20,000 and a weight average molecular weight of from 800 to 100,000, preferably a number average molecular weight of from 1,000 to 15,000 and a weight average molecular weight of from 1,500 to 60,000, and more preferably a number average molecular weight of from 1,500 to 10,000 and a weight average molecular weight of from 2,000 to 30,000, from the viewpoint of preventing the formation of toner film on the carrier and enhancing separativeness of the resultant toner.

As the vinyl monomer for grafting to the polyolefin resin, homopolymers and copolymers of any known vinyl monomers can be used.

Specific examples of the vinyl monomers include, but are not limited to, styrene monomers (e.g., styrene, α-methylstyrene, p-methylstyrene, m-methylstyrene, p-methoxystyrene, p-hydroxystyrene, p-acetoxystyrene, vinyltoluene, ethylstyrene, phenylstyrene, benzylstyrene), alkyl esters of unsaturated carboxylic acids having 1 to 18 carbon atoms (e.g., methyl(meth)acrylate, ethyl(meth)acrylate, butyl(meth)acrylate, and 2-ethylhexyl(meth)acrylate), vinyl ester monomers (e.g., vinyl acetate), vinyl ether monomers (e.g., vinyl methyl ether), vinyl monomers containing a halogen atom (e.g., vinyl chloride), diene monomers (e.g., butadiene, isobutylene), and unsaturated nitrile monomers (e.g., (meth)acrylonitrile, cyanostyrene). These can be used alone or in combination.

Among these, styrene monomers, alkyl esters of unsaturated carboxylic acids, (meth)acrylonitrile, and combinations thereof are preferably used; and styrene, and a combination of styrene and an alkyl ester of (meth)acrylic acid or (meth) acrylonitrile are more preferably used.

The vinyl resin preferably has an SP (i.e., solubility parameter) value of from 10.0 to 11.5 (cal/cm3)½. The SP value of the vinyl resin is controlled considering that of the binder resin. The SP value can be calculated by Fedors method.

The vinyl resin typically has a number average molecular weight of from 1,500 to 100,000 and a weight average molecular weight of from 5,000 to 200,000, preferably a number average molecular weight of from 2,500 to 50,000 and a weight average molecular weight of from 6,000 to 100,000, and more preferably a number average molecular weight of from 2,800 to 20,000 and a weight average molecular weight of from 7,000 to 50,000.

The vinyl resin typically has a glass transition temperature (Tg) of from 40 to 90° C., preferably from 45 to 80° C., and more preferably from 50 to 70° C. When the Tg is not less than 40° C., preservability of the resultant toner improves. When the Tg is not greater than 90° C., low-temperature fixability of the resultant toner improves.

The graft polymer for use in the present invention can have a structure such that a vinyl resin is grafted to a polyolefin resin, and prepared by any known methods.

For example, such a graft polymer is prepared as follows:

dissolving a polyolefin resin, which composes a main chain of the resultant graft polymer, in an organic solvent;

dissolving a vinyl monomer, which forms a vinyl resin grafted to the polyolefin resin, therein;

graft-polymerizing the polyolefin resin and the vinyl monomer in the organic solvent in the presence of a polymerization initiator such as an organic peroxide.

The weight ratio of the polyolefin resin to the vinyl monomer is preferably from 1/99 to 30/70, and more preferably from 2/98 to 27/83, from the viewpoint of preventing the occurrence of filming problem.

The graft polymer may include unreacted polyolefin resin and vinyl resin which is not grafted. In the present invention, the unmodified polyolefin resin and vinyl resin which is not grafted do not need to be removed, and such a graft polymer is rather preferably used as a mixed resin.

The mixed resin preferably includes the unreacted polyolefin resin in an amount of not greater than 5% by weight, and more preferably not less than 3% by weight, and the vinyl resin which is not grafted in an amount of not greater than 10% by weight, and more preferably not greater than 5% by weight. In the present invention, the mixed resin preferably includes the graft polymer in an amount of not less than 85% by weight, and more preferably not less than 90% by weight.

The ratio of the graft polymer in the mixed resin, the molecular weights of the graft polymer and the vinyl resin, etc., can be varied by controlling the composition of raw materials, the reaction temperature, the reaction time, etc.

Specific examples of the graft polymers include, but are not limited to, graft polymers including the following combinations of (A) a polyolefin resin unit and (B) a vinyl resin unit.

(1) (A) oxidized polypropylene and (B) styrene/acrylonitrile copolymer;

(2) (A) polyethylene/polypropylene mixture and (B) styrene/acrylonitrile copolymer;

(3) (A) ethylene/propylene copolymer and (B) styrene/acrylic acid/butyl acrylate copolymer (4) (A) polypropylene and (B) styrene/acrylonitrile/butyl acrylate/monobutyl maleate copolymer;

(5) (A) maleinated polypropylene and (B) styrene/acrylonitrile/acrylic acid/butyl acrylate copolymer;

(6) (A) maleinated polypropylene and (B) styrene/acrylonitrile/acrylic acid/2-ethylhexyl acrylate copolymer; and (7) (A) polyethylene/maleinated polypropylene mixture and (B) acrylonitrile/butyl acrylate/styrene/monobutyl maleate copolymer.

The graft polymer can be prepared as follows, for example:

dissolving or dispersing a wax such as a polyolefin resin in a solvent such as toluene and xylene;

heating the mixture to a temperature of from 100 to 200° C.;

adding a vinyl monomer and a peroxide polymerization initiator thereto; and removing the solvent.

Specific examples of the peroxide initiator include, but are not limited to, benzoyl peroxide, di-tert-butyl peroxide, and tert-butyl peroxide benzoate.

The amount of the peroxide initiator is typically from 0.2 to 10% by weight, and preferably from 0.5 to 5% by weight, based on total weight of the raw materials.

As mentioned above, the graft polymer may include unreacted polyolefin resin and vinyl resin which is not grafted. In the present invention, the unmodified polyolefin resin and vinyl resin which is not grafted do not need to be removed, and such a graft polymer is rather preferably used as a mixed resin.

The graft polymer typically includes the polyolefin resin unit in an amount of from 1 to 90% by weight, and preferably from 5 to 80% by weight. The graft polymer typically includes the vinyl resin unit in an amount of from 10 to 99% by weight, and preferably from 20 to 95% by weight.

The toner typically includes the graft polymer, including unreacted polyolefin resin and vinyl resin which is not grafted, in an amount of from 5 to 300 parts by weight, and preferably from 10 to 150 parts by weight, based on 100 parts by weight of the wax, from the viewpoint of stably dispersing the wax.

Further, amount of graft polymers including a polyolefin resin unit and a vinyl resin unit is preferably from 10 to 150 parts by weight, based on 100 parts weight of the wax, and vinyl resin include at least of one of selected from styrene and (meth)alkyl acrylate ester, (meth)acrylonitorile.

Magnetic Material

As magnetic materials that can be used in the toner of the present invention, the following compounds can be used: (1) magnetic iron oxides (e.g., magnetite, magnetite, ferrite) and iron oxides including other metal oxides; (2) metals (e.g., iron, cobalt, nickel) and metal alloys of the above metals with aluminum, cobalt, copper, lead, magnesium, tin, zinc, antimony, beryllium, bismuth, cadmium, calcium, manganese, selenium, titanium, tungsten, vanadium, etc.; and (3) mixtures thereof.

Specific examples of the magnetic materials include, but are not limited to, $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. These can be used alone or in combination. Among these, powders of $Fe_3O_4$ and $\gamma$-$Fe_2O_3$ are preferably used.

In addition, magnetic iron oxides (e.g., magnetite, magnetite, ferrite) containing a dissimilar element and mixtures thereof can also be used. Specific examples of the dissimilar elements include, but are not limited to, lithium, beryllium, boron, magnesium, aluminum, silicon, phosphorus, germanium, zirconium, tin, sulfur, calcium, scandium, titanium, vanadium, chromium, manganese, cobalt, nickel, copper, zinc, and gallium. Among these, magnesium, aluminum, silicon, phosphorus, and zirconium are preferably used. The dissimilar element may be incorporated into the crystal lattice of an iron oxide; the oxide thereof may be incorporated into an iron oxide; or the oxide or hydroxide thereof may be present at the surface of an iron oxide. However, it is preferable that the oxide of the dissimilar element is incorporated into an iron oxide.

The dissimilar element is incorporated into a magnetic iron oxide by mixing a salt of the dissimilar element and the magnetic iron oxide and controlling the pH. The dissimilar element is deposited out on the surface of a magnetic iron oxide by adding a salt of the dissimilar element and controlling the pH.

The toner preferably includes the magnetic material in an amount of from 10 to 200 parts by weight, and more preferably from 20 to 150 parts by weight, based on 100 parts by weight of the binder resin. The magnetic material preferably has a number average particle diameter of from 0.1 to 2 μm, and more preferably from 0.1 to 0.5 μm. The number average particle diameter can be determined from a magnified photographic image obtained by a transmission electron microscope using a digitizer.

The magnetic material preferably has a coercive force of from 20 to 150 oersted, a saturation magnetization of from 50 to 200 emu/g, and a residual magnetization of from 2 to 20 emu/g, when 1OK oersted of magnetic field is applied.

The magnetic material can also be used as a colorant.

Charge Controlling Agent

The toner of the present invention may optionally include a charge controlling agent.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

The charge controlling agent and the wax can be melt-kneaded with the master batch or the binder resin, or directly added to the organic solvent.

<Flowability Improver>

It is also be permissible to add a flowability improver to the toner according to the present invention. The flowability improver improves the flowability of the toner, i.e., makes the toner more liquid, upon an application of the flowability improver to the surface of the toner.

As an example of the flowability improver, there may be exemplified carbon black, a fluorine resin powder such as fluoride vinylidene fine grain powder or polytetrafluoroethylene fine grain powder, a fine grain powder silica such as a wet process silica or a dry process silica, a fine grain powder titanium oxide, a fine grain powder aluminum oxide, a processed silica, a processed titanium oxide, or a processed aluminum oxide, whereupon a surface processing of the silica, the titanium oxide, or the aluminum oxide, is carried out by way of a silane coupling agent, a titanium coupling agent, or a silicon oil. From among these substances, the fine grain powder silica, the fine grain powder titanium oxide, or the fine grain powder aluminum oxide would be preferable, and moreover, the processed silica whereupon the surface processing of the silica by way of the silane coupling agent or the silicon oil is further preferable.

The particle diameter of the flowability improver preferably, as an average primary particle diameter falls into a range of 0.001 μm to 2 μm, with a range of 0.002 μm to 0.2 μm being more preferable.

The fine particle powder silica is a fine particle body that is generated by way of a gaseous phase oxidation of a silicon halide, which is referred to as dry process silica or a fumed silica.

As an instance of a commercially available silica fine powder that is generated by the gaseous phase oxidation of the silicon halide, there may be exemplified AEROSIL, AEROSIL-130, AEROSIL-300, AEROSIL-380, AEROSIL-TT600, AEROSIL-MOX170, AEROSIL-MOX80, or AEROSIL-COK84, which are products of Nippon Aerosil; Ca-O-SiL-M-5, Ca-O-SiL-MS-7, Ca-O-SiL-MS-75, Ca-O-SiL-HS-5, or Ca-O-SiL-EH-5, which are products of Cabot Corporation; WACKER HDK-N20 V15, WACKER HDK-N20E, WACKER HDK-T30, OR WACKER HDK-T40, which are products of Waeker-Chiemie GmbH; D-C Fine Silica, a product of Dow Corning Toray Co., Ltd.; or FRANSOL, a product of Fransil Co., Ltd.

Furthermore, it would be more preferable still for the silica fine grain body that is generated by the gaseous phase oxidation of the substance containing silicon halide to include a processed silica fine grain body whereupon a hydrophobicity process has been performed. With respect to the processed silica fine grain body, it would be especially preferable the silica fine grain body to be processed such that a degree of the hydrophobicity that is measured by a methanol titration test preferably denotes a value that falls into a range of between 30% and 80%. The hydrophobicity is applied by way of either a reaction with the silica fine grain body, or either a chemical or a physical process, with such as an organic silicon compound that physically adsorbs the silica fine grain body. As a preferable method of the hydrophobicity, a method that processes the silica fine grain body that is generated by the gaseous phase oxidation of the substance containing silicon halide with the organic silicon compound would be desirable.

As the organic silicon compound, there may be exemplified hydroxypropyl trimethoxysilane, phenyl trimethoxysilane, n-hexadecyl trimethoxysilane, n-octadecyl trimethoxysilane, vinyl methoxysilane, vinyl triethoxysilane, vinyl triacetoxysilane, dimethyl vinyl chlorosilane, divinyl chlorosilane, γ-methacrylamide oxypropyl trimethoxysilane, hexamethyl disilane, trimethylsilane, trimethyl chlorosilane, dimethyl dichlorosilane, methyl trichlorosilane, allyl dimethyl chlorosilane, allyl phenyl dichlorosilane, benzyl dimethyl chlorosilane, bromomethyl dimethyl chlorosilane, α-chlorethyl trichlorosilane, β-chloroethyl trichlorosilane, chloromethyl dimethylchlorosilane, triorganosilyl mercaptan, trimethylsilyl mercaptan, triorganosilyl acrylate, vinyl dimethyl acetoxysilane, dimethylethoxysilane, trimethyl othoxysilane, trimethyl methoxysilane, methyl triethoxysilane, isobutyl trimethoxysilane, dimethyl dimethoxysilane, diphenyl diethoxysilane, hexamethyl disiloxane, 1,3-divinyl tetramethyl disiloxane, or 1,3-diphenyl tetramethyl disiloxane, as well as a dimethyl polysiloxane, having between 2 and 12 siloxane units per molecule, and either zero or one hydroxyl group bonded to a silicon atom on a basis of a unit that is located at an end of the molecule, respectively. Furthermore, there may also be exemplified silicon oil, such as dimethyl silicon oil. These may be used alone or in combination.

As a number average diameter of the flowability improver, it is preferable to fall into a range of 5 nm to 100 nm, with a range of 5 nm to 50 nm being more preferable.

It is preferable for a specific surface area by way of a nitrogen adsorption that is measured with a BET technique to have a specific surface area that is 30 m2/g or greater, with a specific surface area that falls into a range of 60 m2/g to 400 m2/g being more preferable. It would be preferable for the fine powder that is surface treated to be 20 m2/g or greater, with a range of 40 m2/g to 300 m2/g being more preferable.

The appropriate use amount of the fine powders described herein is preferably 0.03 parts by mass to 8 parts by mass relative to 100 parts by mass of the toner particles.

(Cleanability Improving Agent)

A cleanability improving agent may be added to the toner so as to remove toner particles remaining on the surface of a photoreceptor or a primary transfer medium after a toner image is transferred onto a recording paper, etc. Specific examples of the cleanability improving agents include, but are not limited to, fatty acids and metal salts thereof such as stearic acid, zinc stearate, and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 μm to 1 μm are preferably used as the cleanability improving agent.

The fluidity improving agent and the cleanability improving agent are fixed on the surface of mother toner particles. Therefore, these agents are called external additives. Suitable mixers for use in mixing the mother toner particles and the external additive include known mixers for mixing powders. Specific examples of the mixers include V-form mixers, locking mixers, Loedge Mixers, NAUTER MIXERS, HENSCHEL MIXERS and the like mixers. When fixing the external additive on the surface of the mother toner particles, HYBRIDIZER, MECHANOFUSION, Q-TYPE MIXER, etc. can be used.

Carrier

The toner of the present invention can be mixed with a carrier so as to be used for a two-component developer. As the carrier, typical ferrite, magnetite, and a carrier covered with a resin (hereinafter referred to as resin-covered carrier) can be used.

The resin-covered carrier comprises a core and a covering material (i.e., resin) which covers the surface of the core.

Specific examples of the resins used for the covering material include, but are not limited to, styrene-acrylic resins (e.g., styrene-acrylate copolymer, styrene-methacrylate copolymer), acrylic resins (e.g., acrylate copolymer, methacrylate copolymer), fluorocarbon resins (e.g., polytetrafluoroethylene, monochlorotrifluoroethylene polymer, polyvinylidene fluoride), silicone resin, polyester resin, polyamide resin, polyvinyl butyral, aminoacrylate resin, ionomer resin, polyphenylene sulfide resin. These can be used alone or in combination.

A core in which a magnetic powder is dispersed in a resin can also be used.

Specific examples of methods for covering the surface of a core with a covering material (i.e., resin) include a method in which a solution or suspension of the resin is coated on the core, and a method in which the powder resin is mixed with the resin.

The resin-covered carrier preferably includes the covering material in an amount of from 0.01 to 5% by weight, based of amount of 100 parts weight % and more preferably from 0.1 to 1% by weight.

As a covering material, mixtures of two or more compounds can also be used. For example, (1) 100 parts by weight of a titanium oxides treated with 12 parts by weight of a mixture of dimethyldichlorosilane and dimethyl silicone oil (mixing weight ratio is 1/5) and (2) 100 parts by weight of a silica treated with 20 parts by weight of a mixture of dimethyldichlorosilane and dimethyl silicone oil (mixing weight ratio is 1/5) can be used.

Among the above-mentioned resins, styrene-methyl methacrylate copolymer, mixtures of a fluorocarbon resin and a styrene copolymer, and silicone resin are preferably used, and silicone resin are more preferably used.

Specific examples of the mixtures of a fluorocarbon resin and a styrene copolymer include, but are not limited to, a mixture of polyvinylidene fluoride and styrene/methyl methacrylate copolymer; a mixture of polytetrafluoroethylene and styrene/methyl methacrylate copolymer; and a mixture of vinylidene fluoride/tetrafluoroethylene copolymer (copolymerization ratio is from 10:90 to 90:10 by weight), styrene/2-ethylhexyl acrylate copolymer (copolymerization ratio is from 10:90 to 90:10 by weight), and styrene/2-ethylhexyl acrylate/methyl methacrylate copolymer (copolymerization ratio is (20 to 60): (5 to 30): (10 to 50) by weight).

Specific examples of the silicone resins include, but are not limited to, a silicone resin containing nitrogen and a modified silicone resin formed by reacting a silane-coupling agent containing nitrogen with a silicone resin.

Magnetic materials used for the core include, but are not limited to, oxides such as ferrite, iron excess ferrite, magnetite, and γ-iron oxide; metals such as iron, cobalt, an nickel and alloys thereof.

Specific examples of the elements included in these magnetic materials include, but are not limited to, iron, cobalt, nickel, aluminum, copper, lead, magnesium, tin, zinc, antimony, beryllium, bismuth, calcium, manganese, selenium, titanium, tungsten, and vanadium. Among these, Cu—Zn—Fe ferrites including copper, zinc, and iron as main components and Mn—Mg—Fe ferrites including manganese, magnesium, and iron as main components are preferably used.

The carrier preferably has a resistivity of from 106 to 1010 Ω·cm by controlling the roughness and of the surface and the amount of the covering resin.

The carrier typically has a particle diameter of from 4 to 200 μm, preferably from 10 to 150 μm, and more preferably from 20 to 100 μm. The resin-covered carrier preferably has a 50% particle diameter of from 20 to 70 μm.

The two-component developer preferably includes the toner of the present invention in an amount of from 1 to 200 parts by weight, and more preferably 2 to 50 parts by weight, based on 100 parts by weight of the carrier.

When the toner of the present invention is developed, any known electrostatic latent image bearing members used for electrophotography can be used. For example, organic image bearing member, amorphous silica image bearing member, selenium image bearing member, zinc oxide image bearing member, etc. can be preferably used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Manufacturing Example of Graft Polymer 1

In an autoclave reaction vessel equipped with a thermometer and a stirrer, 480 parts of xylene and 100 parts of a low-molecular-weight polyethylene (SANWAX® LEL-400 from Sanyo Chemical Industries, Ltd., having a melting point of 128° C.) are contained and mixed. The atmosphere in the reaction vessel is replaced with nitrogen. Next, a mixture liquid of 755 parts of styrene, 100 parts of acrylonitrile, 45 parts of butyl acrylate, 21 parts of acrylic acid, 36 parts of di-t-butyl peroxyhexahydroterephthalate, and 100 parts of xylene is dropped therein over a period of 3 hours at 170° C. so as to be polymerized, and then left for 0.5 hours. The solvent (xylene) is removed therefrom.

Thus, a graft polymer (W-1) having a number average molecular weight of 3,300, a weight average molecular weight of 18,000, a glass transition temperature of 65.0° C., and an SP value of the vinyl resin of 11.0 (cal/cm3)½ is prepared.

Manufacturing Example of Graft Polymer 2

In an autoclave reaction vessel equipped with a thermometer and a stirrer, 450 parts of xylene and 200 parts of a low-molecular-weight polyethylene (VISCOL® 440P from Sanyo Chemical Industries, Ltd., having a melting point of 153° C.) are contained and mixed. The atmosphere in the reaction vessel is replaced with nitrogen. Next, a mixture liquid of 280 parts of styrene, 520 parts of methyl methacrylate, 32.3 parts of di-t-butyl peroxyhexahydroterephthalate, and 120 parts of xylene is dropped therein over a period of 2 hours at 150° C. so as to be polymerized, and then left for 1 hour. The solvent (xylene) is removed therefrom.

Thus, a graft polymer (W-2) having a number average molecular weight of 3,300, a weight average molecular weight of 16,000, a glass transition temperature of 58.8° C., and an SP value of the vinyl resin of 10.2 (cal/cm3)½ is prepared.

Manufacturing Example of Graft Polymer 3

In an autoclave reaction vessel equipped with a thermometer and a stirrer, 450 parts of xylene and 150 parts of a mixture (LICOCENE® 1302 from Clariant Japan K. K., having a melting point of 78.9° C.) of a low-molecular-weight polypropylene and a low-molecular-weight polyethylene are contained and mixed. The atmosphere in the reaction vessel is replaced with nitrogen. Next, a mixture liquid of 200 parts of styrene, 460 parts of methyl methacrylate, 140 parts of acrylonitrile, 35 parts of di-t-butyl peroxyhexahydro terephthalate, and 120 parts of xylene is dropped therein over a period of 2 hours at 150° C. so as to be polymerized, and then left for 1 hour. The solvent (xylene) is removed therefrom.

Thus, a graft polymer (W-3) having a number average molecular weight of 2,400, a weight average molecular weight of 14,000, a glass transition temperature of 88.5° C., and an SP value of the vinyl resin of 11.5 (cal/cm3)½ is prepared.

Example 1

Preparation of Colorant Dispersion

At first, 20 parts of a carbon black (REGAL® 400 from Cabot Corporation) and 2 parts of a colorant dispersing agent (AJISPER® PB-821 from Ajinomoto Fine-Techno Co., Inc.) are primarily dispersed in 78 parts of ethyl acetate using a mixer equipped with agitation blades. Thus, a primary dispersion is prepared.

The primary dispersion is subjected to a dispersing treatment using a DYNO-MILL so that the colorant (i.e., carbon black) is much finely dispersed and aggregations thereof are completely removed by applying a strong shear force. Thus, a secondary dispersion is prepared.

The secondary dispersion is filtered with a filter (made of PTFE) having 0.45 μm-sized fine pores. Thus, a colorant dispersion is prepared.

Preparation Resin & Wax Dispersion

In a vessel equipped with a stirrer and a thermometer, 6.25 parts of carnauba wax, 75 parts of ethyl acetate, 10 parts of a carnauba wax are contained. The mixture is heated to 85° C. and mixed for 20 minutes so that the carnauba wax are dissolved, and then rapidly cooled so that particles of the carnauba wax separate out. 18.75(60 parts of weight of graft polymer, based 100 parts of weight carunuba wax) parts of Ethyl acetate solution including the graft polymer (W-1) which solid weight % is 20 was added to the dispersion, then the dispersion was more dispersed using a beas mill LMZ06 (Manufactured by Ashizawa Finetech Ltd.) filling up with zirconia beas of 3.0 mm ϕ so that the dispersion is much finely dispersed by applying a strong shear force.

Then a wax dispersion (WD-1) was prepared. Then, average diameter of wax was 0.29 μm. Particle diameter was measured by mikrotrack particle size distribution mater [Nanotrac150]

Preparation of Toner Constituent Liquid

At first, 471 parts of Ethyl acetate solution including polyester resin (weight average molecular weight 32000) which solid weight % is 20 as binder resin, 50 parts of carbon black dispersion, 128 parts of wax dispersion(WD-1), 531 parts of ethyl acetate are mixed using a mixer equipped with agitation blades. Further, after 48 hour standing the toner composition solution, there is not aggregation and precipitation of Carbon black and wax.

Preparation of Toner

Figure 11A:
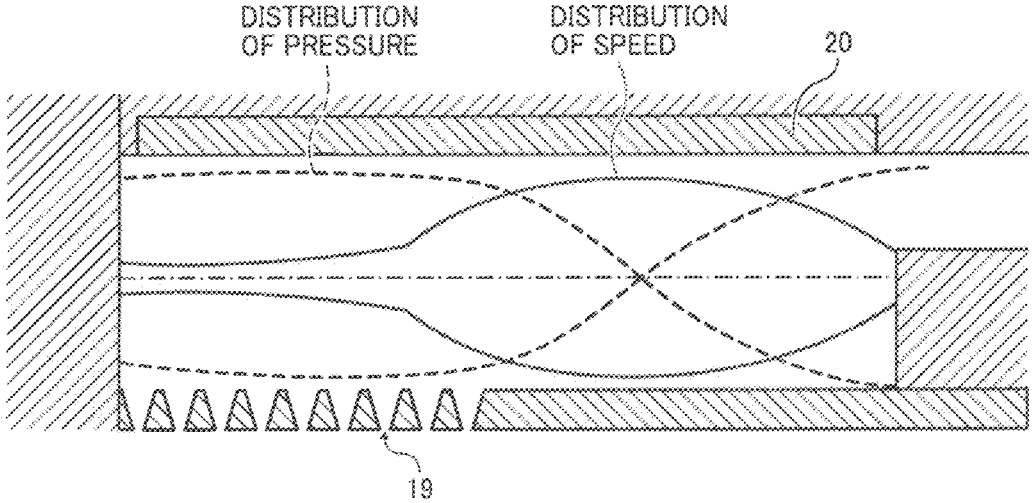
FIGS. 11A and 11B are diagrams illustrating yet still another example of a liquid droplet ejection head.
Figure 11B:
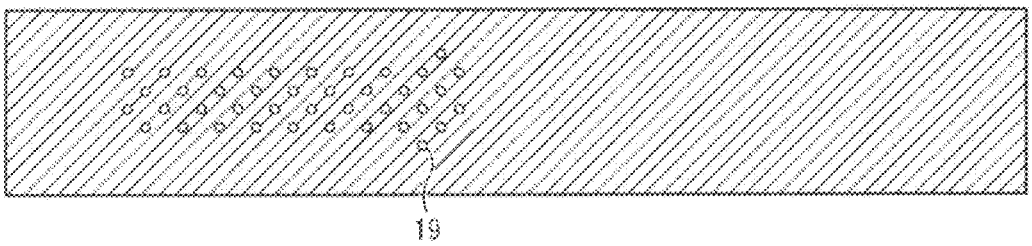
Figure 12A:
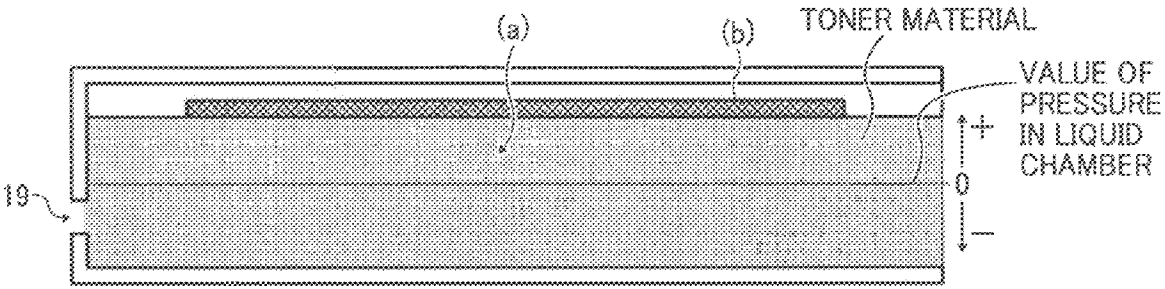
FIGS. 12A to 12E are each cross-sectional diagram illustrating the appearance of liquid droplet behavior in a toner liquid droplet head in a conventional toner production apparatus.
Figure 12B:
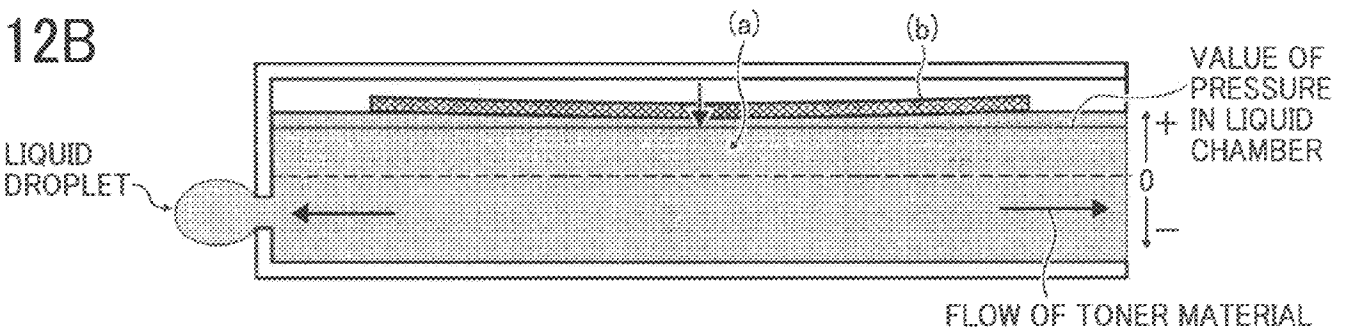
Figure 12C:
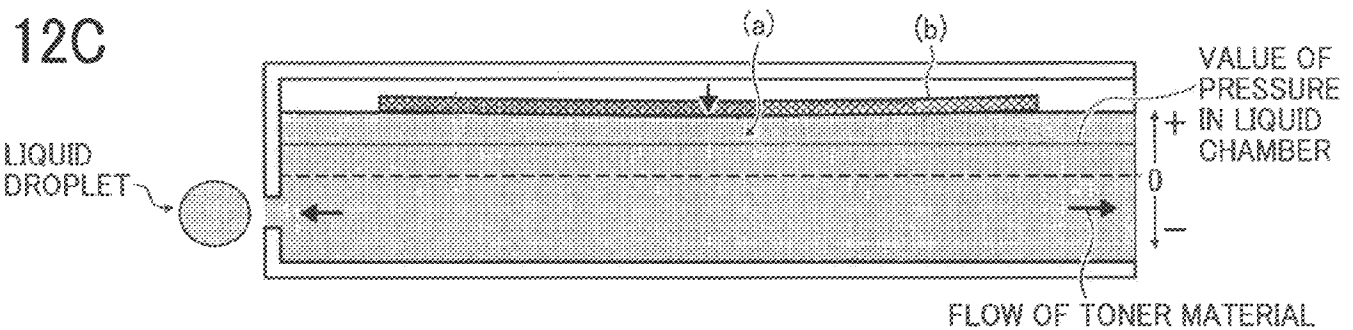
Figure 12D:
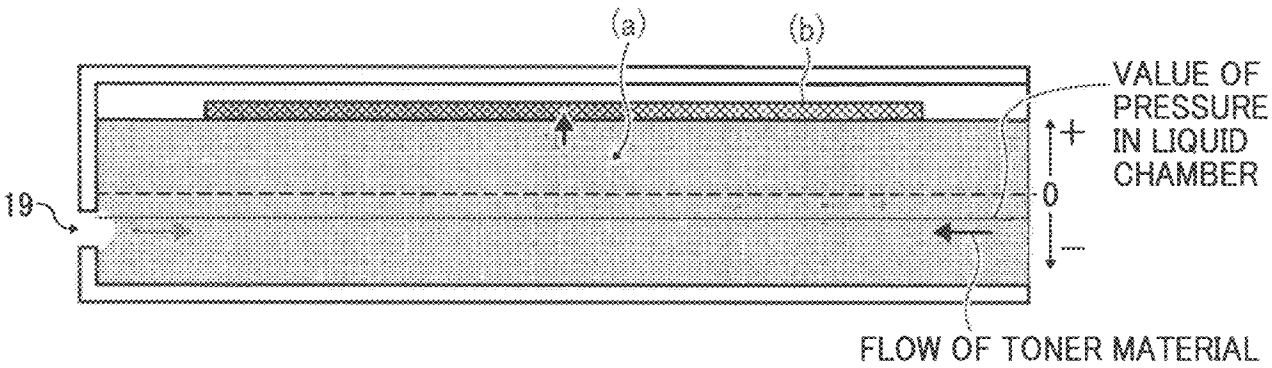
Figure 12E:
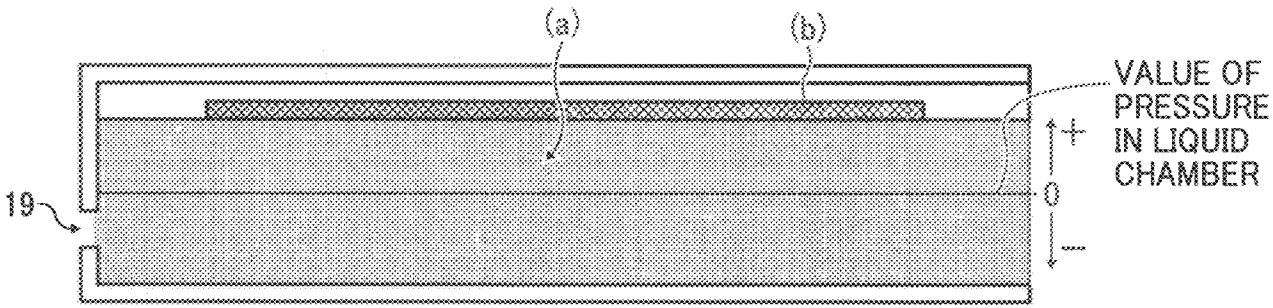

The obtained toner constituent liquid, toner manufactured apparatus showing FIG. 1 having liquid discharged head showing FIG. 11, and discharge liquid drops as follows;

Then, the liquid drops are dried and be-solid and got by cycrne 48 hour at 35° C., toner mather particle was made.

[Toner manufacturing control.]

Specific gravity of dispersion : ρ=1.1[g/cm3]

Discharge hole diameter: 7.5[μmϕ]

Air temperature of drying : 40 [° C.]

Vibration frequency: 395 kHz

Adding voltage : 10.0[V]

The dried mother toner particles are collected using a cyclone collector. Next, 100 parts by weight of the mother toner particles are mixed with 0.7 parts by weight of a hydrophobized silica (H2000 from Clariant Japan KK.) using a HENSCHEL MIXER (from Mitsui Mining Co., Ltd.). Thus, a black toner (a1) is prepared.

Toner was prepared like example 1, then there is a weight average particle diameter (Dw) was 4.9[μm], Dw/Dn was 1.01. Dw/Dn was very sharp.

Further, toner was made 6 hour continually, but didn't clog.

Preparation of Carrier

The following components are mixed for 20 minutes using a HOMOMIXER to prepare a cover layer formation liquid.

Silicone resin (Organo straight silicone) 100 parts

Toluene 100 parts

γ-(2-Aminoethyl)aminopropyl trimethoxysilane 5 parts

Carbon black 10 parts

The cover layer formation liquid is applied on the surfaces of 100 parts of spherical magnetite particles having a particle diameter of 50 μm using a fluidized bed coating device. Thus, a magnetic carrier (A) is prepared.

Preparation of Developer

To evaluate resistance to hot offset and filming problem, a two-component developer 1 is prepared by mixing 4 parts of the toner a and 96 parts of the magnetic carrier.

Results of evaluation are shown following table 1, and hot offset Resistance and Filming Resistance was good.

Particle Diameter

The weight average particle diameter (Dw) and the number average particle diameter (Dn) of a toner are determined using a particle size analyzer COULTER MULTISIZER III (from Beckman Coulter K. K.) with an aperture having a diameter of 100 μm and an analysis software (Beckman Coulter Multisizer 3 Version 3.51).

The measuring method is as follows:

(1) 0.5 ml of a 10% by weight aqueous solution of a surfactant (an alkylbenzene sulfonate NEOGEN SC-A from Dai-ichi Kogyo Seiyaku Co., Ltd.) is contained in a 100 ml glass beaker;

(2) 0.5 g of a toner is added thereto and mixed using a microspatula, and then 80 ml of ion-exchanged water is added thereto to prepare a toner dispersion;

(3) the toner dispersion is subjected to a dispersing treatment using an ultrasonic dispersing machine (W-113MK-II from Honda Electronics Co., Ltd.) for 10 minutes;

(4) the toner dispersion is subjected to a measurement using the instrument COULTER MULTISIZER with using ISOTON III (from Beckman Coulter K. K.) as a measurement liquid, by adding the toner dispersion so that the instrument indicates a toner concentration of from 6 to 10%; and (5) the volume and number distribution are calculated by measuring the volume and number of toner particles, and then the weight particle diameter (D4) and the number average particle diameter (Dn) are determined.

It is important that the measurement toner concentration is from 6 to 10% from the viewpoint of reproducibility of the measurement.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

The ratio (D4/Dn) of the weight particle diameter (D4) to the number average particle diameter (Dn) can be treated as an indicator of the particle diameter distribution. When the ratio (D4/Dn) is 1, the particle diameter distribution is monodisperse. The larger ratio (D4/Dn) a toner has, the wider particle diameter distribution the toner has.

Hot Offset Resistance

A developer is set in a copier (IMAGIO NEO 455 from Ricoh Co., Ltd.). Images are produced on a paper TYPE 6000 (from Ricoh Co., Ltd.) while varying the fixing temperature from a low temperature to a high temperature. A temperature at which the glossiness of an image decreases or offset is observed is defined as "offset occurrence temperature", and evaluated as follows.

Good: The offset occurrence temperature is not less than 200° C.

Poor: The offset occurrence temperature is less than 200° C.

Filming Resistance

A developer is set in a copier (IMAGIO NEO 455 from Ricoh Co., Ltd.). A running test in which an image having an image proportion of 7% is continuously produced is performed using a paper TYPE 6000 (from Ricoh Co., Ltd.). Whether or not the filming problem occurred is evaluated by observing the photoreceptor (whether or not a toner film is formed) and the produced image (whether or not the density unevenness is observed in halftone image), immediately after the 20,000th, 50,000th, and 10,0000th images are produced, and evaluated as follows.

○10,0000th

□50,000th,

×20,000th,

Example 2

The procedure for preparation of the toner and developer in Example 1 is repeated except that the carnauba wax is replaced with a synthesized ester wax (WEP-5 from NOF Corporation).

Further, average diameter of wax is 0.31 μm.

Further, after 48 hour standing, there is not aggregation and precipitation of Carbon black and wax.

Showing the Results of evaluation like example 1 in following table1. Clogging of toner discharging hole by toner composition liquid was not occurred, and a ratio of the weight average particle diameter to a number average particle diameter was sharp, and Hot Offset Resistance and Filming Resistance was good.

Example 3

The procedure for preparation of the toner and developer in Example 1 is repeated except that the carnauba wax is replaced with a paraffin wax (HNP-9 from Nippon Seiro Co., Ltd.).

Further, average diameter of wax is 0.39 μm.

Further, after 48 hour standing, there is not aggregation and precipitation of Carbon black and wax.

Showing the Results of evaluation like example 1 in following table 1. Clogging of toner discharging hole by toner composition liquid was not occurred, and a ratio of the weight average particle diameter to a number average particle diameter was sharp, and Hot Offset Resistance and Filming Resistance was good.

Example 4

The procedure for preparation of the toner and developer in Example 1 is repeated except that the graft polymer (W-1) is replaced with the graft polymer (W-2).

Further, average diameter of wax is 0.32 μm.

Further, after 48 hour standing, there is not aggregation and precipitation of Carbon black and wax.

Showing the Results of evaluation like example 1 in following table 1. Clogging of toner discharging hole by toner composition liquid was not occurred, and a ratio of the weight average particle diameter to a number average particle diameter was sharp, and Hot Offset Resistance and Filming Resistance was good.

Example 5

The procedure for preparation of the toner and developer in Example 1 is repeated except that the graft polymer (W-1) is replaced with the graft polymer (W-3).

Further, average diameter of wax is 0.30 μm.

Further, after 48 hour standing, there is not aggregation and precipitation of Carbon black and wax.

Showing the Results of evaluation like example 1 in following table 1. Clogging of toner discharging hole by toner composition liquid was not occurred, and a ratio of the weight average particle diameter to a number average particle diameter was sharp, and Hot Offset Resistance and Filming Resistance was good.

Example 6

The procedure for preparation of the toner and developer in Example 1 is repeated except that the amount of the graft polymer (W-1) is changed from 60parts to 10 parts based on 100 parts by weight of the wax.

Preparation of wax dispersion was done following.

In a vessel equipped with a stirrer and a thermometer, 9.09 parts of carnauba wax, 90 parts of ethyl acetate are contained. The mixture is heated to 85° C. and mixed for 20 minutes so that the carnauba wax are dissolved, and then rapidly cooled so that particles of the carnauba wax separate out. 4.55 parts of Ethyl acetate solution including the graft polymer (W-1) which solid weight % is 20 was added to the disparsion, then a wax disparsion like above example 1 was prepared. Then, average diameter of wax was 0.41 μm Preparation of Toner Constituent Liquid At first, 491 parts of Ethyl acetate solution including polyester resin(weight average molecular weight 32000) which solid weight % is 20 as binder resin, 50 parts of carbon black dispersion prepared the above example 1, 88 parts of wax dispersion, 551 parts of ethyl acetate are mixed using a mixer equipped with agitation blades. Further, after 48 hour standing the toner composition solution, there is not aggregation and precipitation of Carbon black, but there is a little bit aggregation of wax was watched.

Toner was prepared like example 1, then there is a

Little clogging of toner discharging hole, and weight average particle diameter (Dw) was 5.1[μm], Dw/Dn was 1.06. Dw/Dn was slightly wide.

Showing the Results of evaluation like example 1 in following table1.

Hot offset resistance was good, but after 50,000 reproduction, a little filming is found.

Example 7

The procedure for preparation of the toner and developer in Example 1 is repeated except that the amount of the graft polymer (W-1) is changed from 60 parts to 150 parts based on 100 parts by weight of the wax.

Preparation of wax dispersion was done following.

In a vessel equipped with a stirrer and a thermometer, 4.0 parts of carnauba wax, 66.0 parts of ethyl acetate are contained. The mixture is heated to 85° C. and mixed for 20 minutes so that the carnauba wax are dissolved, and then rapidly cooled so that particles of the carnauba wax separate out. 30.0 parts of Ethyl acetate solution including the graft polymer (W-1) which solid weight % is 20 was added to the dispersion, then a wax dispersion like above example 1 was prepared. Then, average diameter of wax was 0.25 μm.

Preparation of Toner Constituent Liquid

At first, 435 parts of Ethyl acetate solution including polyester resin(weight average molecular weight 32000) which solid weight % is 20 as binder resin, 50 parts of carbon black dispersion prepared the above example 1, 200 parts of wax dispersion, 495 parts of ethyl acetate are mixed using a mixer equipped with agitation blades. Further, after 48 hour standing the toner composition solution, there is not aggregation and precipitation of Carbon black and wax.

Toner was prepared like example 1, then there is a

Little clogging of toner discharging hole, and weight average particle diameter (Dw) was 4.7[μm], Dw/Dn was 1.01. Dw/Dn was slightly wide.

Showing the Results of evaluation like example 1 in following table1.

Clogging of toner discharging hole by toner composition liquid was not occurred, and a ratio of the weight average particle diameter to a number average particle diameter was sharp, and Hot Offset Resistance and Filming Resistance was good.

Comparative Example 1

The procedure for preparation of the toner and developer in Example 1 is repeated except that wax dispersion was not added, and in prepared of toner composition liquid, 531 parts of Ethyl acetate solution including polyester resin(weight average molecular weight 32000) which solid weight % is 20 as binder resin, and 53.64 parts of carbon black dispersion and 595.36 parts of ethyl acetate Showing the Results of evaluation like example 1 in following table 1.

Clogging of toner discharging hole by toner composition liquid was not occurred, and a ratio of the weight average particle diameter to a number average particle diameter was sharp, and Hot Offset Resistance and Filming Resistance was good.

Comparative Example 2

The procedure for preparation of the wax dispersion in example 1 is repeated except that graft polymer (W-1) was not added, 10 parts of the carnauba wax and 90 parts of ethyl acetate And, in the toner composition liquid, in prepared of toner composition liquid, 495 parts of Ethyl acetate solution including polyester resin(weight average moriculer weight 32000) which solid weight % is 20 as binder resin, and 50 parts of carbon black dispersion and 555 parts of ethyl acetate.

Further, after 8 hour standing the toner composition solution, Aggregation and precipitation are occurred.

Showing the Results of evaluation like example 1 in following table 1.

Clogging of toner discharging hole by toner composition liquid was occurred, and a ratio of the weight average particle diameter to a number average particle diameter was broad, and Hot Offset Resistance and Filming Resistance was not good.

Comparative Example 3

The procedure for preparation of the wax dispersion in example 2 is repeated except that graft polymer (W-1) was not added, 10 parts of the Synthetic ester wax (WEP-5, manufactured by NOF CORPORATION.) and 90 parts of ethyl acetate And, in the toner composition liquid, in prepared of toner composition liquid, 495 parts of Ethyl acetate solution including polyester resin(weight average molecular weight 32000) which solid weight % is 20 as binder resin, and 50 parts of carbon black dispersion and 555 parts of ethyl acetate Further, after 8 hour standing the toner composition solution, Aggregation and precipitation are occurred.

Showing the Results of evaluation like example 2 in following table 1.

Clogging of toner discharging hole by toner composition liquid was occurred, and a ratio of the weight average particle diameter to a number average particle diameter was broad, and Hot Offset Resistance and Filming Resistance was not good.

Comparative Example 3 4

The procedure for preparation of the wax dispersion in example 3 is repeated except that graft polymer (W-1) was not added, 10 parts of the a paraffin wax (HNP-9 from Nippon Seiro Co., Ltd.) and 90 parts of ethyl acetate And, in the toner composition liquid, in prepared of toner composition liquid, 495 parts of Ethyl acetate solution including styrene/acrylacid butyl copolymer (weight average molecular weight 51000) which solid weight % is 20 as binder resin, and 50 parts of carbon black dispersion and 555 parts of ethyl acetate Further, after 8 hour standing the toner composition solution, Aggregation and precipitation are occurred.

Showing the Results of evaluation like example 1 in following table 1.

Clogging of toner discharging hole by toner composition liquid was occurred, and a ratio of the weight average particle diameter to a number average particle diameter was broad, and Hot Offset Resistance was good, but Filming Resistance was not good.

As explained above, the liquid droplet discharge head in FIG. 2 has toner composition liquid 14 inside the liquid column resonance-generating chamber. Vibration is applied by the vibration generating unit 20 and antinode of a standing wave is generated by the vibration generating unit inside the liquid column resonance-generating chamber.

Further, a part of the material comprising the liquid column resonance-generating 18 will be antinode of the standing wave.

And, the area of antinode of the standing wave will be high pressure.

In this invention, inside the liquid column resonance-generating chamber 18, a pressure distribution is formed by the liquid column resonance-generating.

Then, in the liquid column resonance-generating chamber 18, a pressure distribution is formed. This pressure distribution is not one-sided, and liquid can be efficiently ejected even if the ejection hole is small. Further, when toner ejection hole 19 is small, clogging is not observed. Further, toner composition liquid 14 is may be discharged constantly, from ejection hole 19 and the productivity of toner is high. Further, toner composition 14 includes a graft polymer comprising at least of a polyolefin resin unit and a vinyl resin unit, making binding strong between the wax and the graft polymer. That is, the wax does not adhere to the photoconductor in the development process, reducing the photoconductor filming phenomenon.

Further, according this embodiment, an antinode of a liquid column resonance standing wave formed onto liquid column resonance-generating chamber 18 of FIG. 2. To at least one of this are wherein the ejection hole 19 is formed in plurality with respect to at least one region, which is the region corresponding to the antinode. This antinode of a liquid column resonance standing wave area is sufucient large amplitude to pressure movement of an antinode of a liquid column resonance standing wave discharge the toner component liquid 19.

Therefore, the toner discharge hole 19 formed onto this antinode of a liquid column resonance standing wave may form almost homogeneous toner liquid drops. Further, discharge of toner liquid drop may be formed by high pressure movement, then clogging of toner discharge hole 19 don't occurred, then may be high productivity.

Further, according this embodiment, the above example 6 and 7, wherein the toner constituent liquid comprises the graft polymer in an amount of from 10 to 150 parts by weight based on 100 parts by weight of the wax, dispersion stability of wax is improved, and photoconductor filming is improved.

Further, according this embodiment, when the vinyl resin including graft polymer comprises at least one member selected from the group consisting of a styrene unit, an alkyl acrylate unit, an alkyl methacrylate unit, an acrylonitrile unit, and a methacrylonitrile unit, little dispersion and aggregation are more prevented, clogging of the toner discharge hole 19 may be prevent more efficiently, and reducing of productivity is prevented.

Further, it is preferred that the toner has a ratio of the weight average particle diameter to a number average particle diameter of from 1.00 to 1.15, and that the toner have a weight average particle diameter of from 1 to 10 μm.

The above written description of the invention provides a manner and process of making and using it such that any person skilled in this art is enabled to make and use the same, this enablement being provided in particular for the subject matter of the appended claims, which make up a part of the original description.

As used herein, the words "a" and "an" and the like carry the meaning of "one or more." The phrases "selected from the group consisting of," "chosen from," and the like include mixtures of the specified materials. Terms such as "contain(s)" and the like are open terms meaning 'including at least' unless otherwise specifically noted.

All references, patents, applications, tests, standards, documents, publications, brochures, texts, articles, etc. mentioned herein are incorporated herein by reference. Where a numerical limit or range is stated, the endpoints are included. Also, all values and subranges within a numerical limit or range are specifically included as if explicitly written out.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein. In this regard, certain embodiments within the invention may not show every benefit of the invention, considered broadly.

The invention claimed is:

1. A method for producing toner particles, comprising:

ejecting a liquid from at least one ejection hole to form the liquid into liquid droplets, and solidifying the liquid droplets to produce toner particles, wherein the liquid comprises a solvent, a resin, a colorant, a wax, and a graft polymer comprising a polyolefin resin unit and a vinyl resin unit, and wherein the ejecting the liquid is accomplished by applying a vibration to the liquid in a liquid column resonance-generating liquid chamber in which an ejection hole is formed to form a standing wave through liquid column resonance, and ejecting the liquid from the ejection hole which is formed in a region corresponding to an antinode of the standing wave to thereby form the liquid into the liquid droplets.

2. The method according to claim 1, wherein the liquid column resonance-generating liquid chamber comprises plural ejection holes at locations corresponding to antinodes.

3. The method according to claim 1, wherein the liquid comprises the graft polymer in an amount of from 10 to 150 parts by weight based on 100 parts by weight of the wax.

4. The method according to claim 1, wherein the vinyl resin unit comprises at least one member selected from the group consisting of a styrene unit, an alkyl acrylate unit, an alkyl methacrylate unit, an acrylonitrile unit, and a methacrylonitrile unit.

5. The method according to claim 1, wherein the vibration is a drive frequency f which is represented by the following Expression (2):

$$N \times c/(4L) \leq f \leq N \times c/(4Le) \quad \text{Expression (2)}$$

L: a length from an edge of a frame on a fixed edge side to the other edge thereof on the side of a liquid supply path, c: a sound speed of a liquid in the liquid column resonance-generating liquid chamber, N: an even number, Le: a distance between the end of the liquid column resonance-generating liquid chamber on the liquid feed side and a center portion of a liquid droplet ejection hole nearest to the end of the liquid column resonance-generating liquid chamber on the liquid feed side.

6. The method according to claim 1, wherein the vibration is a drive frequency f which is represented by the following:

$$Le/L > 0.6$$

L: a length from an edge of a frame on a fixed edge side to the other edge thereof on the side of a liquid supply path, Le: a distance between the end of the liquid column resonance-generating liquid chamber on the liquid feed side and a center portion of a liquid droplet ejection hole nearest to the end of the liquid column resonance-generating liquid chamber on the liquid feed side.

7. The method according to claim 1, wherein the vibration is a drive frequency f which is represented by the following Expression (3):

$$N \times c/(4L) \leq f \leq (N+1) \times c/(4Le) \quad \text{Expression (3)}$$

L: a length from an edge of a frame on a fixed edge side to the other edge thereof on the side of a liquid supply path, c: a sound speed of a liquid in the liquid column resonance-generating liquid chamber, N: an even number, Le: a distance between the end of the liquid column resonance-generating liquid chamber on the liquid feed side and a center portion of a liquid droplet ejection hole nearest to the end of the liquid column resonance-generating liquid chamber on the liquid feed side.

8. The method according to claim 2, wherein the ejection holes have an aperture diameter of from 1 μm to 40 μm.

* * * * *